US009873270B2

(12) United States Patent
Kimura

(10) Patent No.: US 9,873,270 B2
(45) Date of Patent: Jan. 23, 2018

(54) PRINTER AND METHOD OF OBTAINING INCLINATION INFORMATION OF GUIDE OF PRINTER

(71) Applicant: BROTHER KOGYO KABUSHIKI KAISHA, Nagoya-shi, Aichi-ken (JP)

(72) Inventor: Aya Kimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/464,507

(22) Filed: Mar. 21, 2017

(65) Prior Publication Data

US 2017/0282607 A1 Oct. 5, 2017

(30) Foreign Application Priority Data

Mar. 31, 2016 (JP) ..... 2016-073388

(51) Int. Cl.

| | |
|---|---|
| ***B41J 29/38*** | (2006.01) |
| ***B41J 13/00*** | (2006.01) |
| ***B41J 25/00*** | (2006.01) |
| ***B41J 2/045*** | (2006.01) |

(52) U.S. Cl.

CPC ..... *B41J 13/0009* (2013.01); *B41J 2/04573* (2013.01); *B41J 25/006* (2013.01)

(58) Field of Classification Search

CPC .... B41J 2/04573; B41J 25/308; B41J 11/008; B41J 25/006; B41J 13/0009

USPC ..... 347/5, 8, 9, 16

See application file for complete search history.

(56) References Cited

U.S. PATENT DOCUMENTS

| | | | | |
|---|---|---|---|---|
| 8,162,425 | B2 * | 4/2012 | Kato | B41J 11/007 347/101 |
| 8,882,215 | B2 * | 11/2014 | Arakane | B41J 2/04508 347/104 |
| 9,731,527 | B2 * | 8/2017 | Hoshii | B41J 25/006 |
| 2012/0249643 | A1 | 10/2012 | Kawagoe | |
| 2013/0257936 | A1 | 10/2013 | Terada | |

(Continued)

FOREIGN PATENT DOCUMENTS

| | | | |
|---|---|---|---|
| JP | 2012-236348 | A | 12/2012 |
| JP | 2013-212584 | A | 10/2013 |

(Continued)

*Primary Examiner* — An Do

(74) *Attorney, Agent, or Firm* — Scully, Scott, Murphy & Presser, PC

(57) ABSTRACT

There is provided a printer including: a conveyance unit; a liquid jetting head including at least one nozzle array in which nozzles are arrayed; a carriage; a guide; a carriage moving unit; a memory; and a controller. The controller performs printing by performing scan printing operation and a conveyance operation multiple times repeatedly and adjusts jetting timings of the liquid jetted from the nozzles at positions in a scanning direction based on pieces of inclination information corresponding to the respective positions. In second or subsequent scan printing operation of the multiple times of scan printing operation, the controller delays or advances, based on the inclination information, the jetting timing in the second or subsequent scan printing operation relative to the jetting timing in scan printing operation immediately before the second or subsequent scan printing operation more greatly, as inclination of the at least one nozzle array increases.

12 Claims, 16 Drawing Sheets

(56) References Cited

U.S. PATENT DOCUMENTS

| | | | |
|---|---|---|---|
| 2013/0257937 | A1 | 10/2013 | Arakane |
| 2013/0257940 | A1 | 10/2013 | Terada |
| 2014/0292867 | A1 | 10/2014 | Takata |

FOREIGN PATENT DOCUMENTS

| | | | |
|---|---|---|---|
| JP | 2013-212585 | A | 10/2013 |
| JP | 2013-226801 | A | 11/2013 |
| JP | 5472184 | B2 | 4/2014 |
| JP | 2014-193531 | A | 10/2014 |

* cited by examiner

PRINTER AND METHOD OF OBTAINING INCLINATION INFORMATION OF GUIDE OF PRINTER

CROSS REFERENCE TO RELATED APPLICATION

The present application claims priority from Japanese Patent Application No. 2016-073388 filed on Mar. 31, 2016, the disclosure of which is incorporated herein by reference in its entirety.

BACKGROUND

Field of the Invention:

The present teaching relates to a printer that performs printing by jetting liquid from nozzles, and a method of obtaining inclination information of a guide guiding the carriage of the ink-jet head of the printer.

Description of the Related Art:

As an exemplary printer that performs printing by jetting liquid from nozzles, there is known a printer that performs printing on a recording sheet by jetting ink from nozzles. In such a well-known printer, an ink-jet head may include a nozzle array formed by arraying the nozzles in a conveyance direction of the recording sheet. The well-known printer performs printing on the recording sheet by alternately performing a jetting operation (scan printing operation) and a conveyance operation. In the jetting operation, ink is jetted from nozzles to the recording sheet placed on a platen while a carriage carrying the ink-jet head moves along guide rails in a scanning direction orthogonal to the conveyance direction. In the conveyance operation, a conveyance mechanism conveys the recording sheet in the conveyance direction.

SUMMARY

In the above printer, guide rails may not maintain their linearity due to, for example, a slight deformation of the guide rails at the time of formation thereof or a slight deformation of the guide rails at the time of assembling them on the printer. The guide rail deformation may cause the carriage moving along the guide rails to be inclined during movement, resulting in inclination of the nozzle array with respect to the conveyance direction within a plane parallel to the conveyance direction and the scanning direction. The guide rails may be deformed in various directions at positions in the scanning direction. Thus, the inclination angle of the nozzle array to the conveyance direction may depend on the position in the scanning direction. When the nozzle array is inclined in scan printing, a seam or a joint between images to be printed by the scan printing shifts in the scanning direction, resulting in deterioration in image quality.

An object of the present teaching is to provide a printer that prevents a shift of a seam between images to be printed by scan printing in a scanning direction, even when guides guiding a carriage in the scanning direction have a deformation.

According to an aspect of the present teaching, there is provided a printer including:

a conveyor configured to convey a recording medium in a conveyance direction;

a liquid jetting head including a nozzle array in which nozzles are aligned in the conveyance direction;

a carriage carrying the liquid jetting head;

a guide guiding the carriage;

a carriage moving unit configured to move the carriage in a state where the carriage is guided by the guide, a moving direction of the carriage being a direction intersecting with the conveyance direction;

a memory configured to store pieces of inclination information at positions in the scanning direction, each piece of inclination information relating to inclination of the nozzle array with respect to the conveyance direction within a plane parallel to the conveyance direction and the scanning direction, the inclination being caused by a deformation of the guide; and a controller configured to control the conveyor, the liquid jetting head, and the carriage moving unit, to perform:

printing by performing a scan printing operation and a conveyance operation multiple times repeatedly, wherein, in the scan printing operation, the liquid jetting head is controlled to jet the liquid from the nozzles while the carriage is moved in the moving direction, and in the conveyance operation, the conveyor is controlled to convey the recording medium in the conveyance direction; and adjusting a jetting timing of the liquid at each of the positions based on the inclination information corresponding to each of the positions, wherein, in second or subsequent scan printing of the multiple times of scan printing, the controller is configured to perform:

delaying the jetting timing in the second or subsequent scan printing relative to the jetting timing in scan printing immediately before the second or subsequent scan printing more greatly as the inclination increases, in a case that the inclination information indicates inclination in which a most downstream nozzle of the nozzle array in the conveyance direction is positioned upstream in the moving direction of the carriage with respect to a most upstream nozzle in the conveyance direction; and advancing the jetting timing in the second or subsequent scan printing relative to the jetting timing in the scan printing immediately before the second or subsequent scan printing more greatly as the inclination increases, in a case that the inclination information indicates inclination in which the most downstream nozzle is positioned downstream in the moving direction of the carriage with respect to the most upstream nozzle.

In the printer of the present teaching, the memory stores the inclination information at each of the positions in the moving direction of the carriage (hereinafter, also referred to as a scanning direction), the inclination information relating to the inclination of the at least one nozzle array with respect to the conveyance direction within the plane parallel to the conveyance direction and the scanning direction, the inclination being caused by the deformation of the guide. In the scan printing, the jetting timing at each of the positions is adjusted based on the inclination information corresponding to each of the positions. Further, the jetting timing in the second or subsequent scan printing is adjusted relative to the jetting timing in the scan printing immediately before the second or subsequent scan printing (the jetting timing in the last scan printing) based on the inclination indicated by the inclination information. Since the jetting timing at each of the positions is adjusted by reflecting the inclination information and the last scan printing, a shift, of a seam between images to be printed by the scan printing, in the scanning direction, may be prevented even when the guide has a deformation.

BRIEF DESCRIPTION OF THE DRAWINGS

FIGS. 8A to 8C each illustrate an image to be printed by scan printing, wherein FIG. 8A depicts an image obtained when no nozzle array is inclined, FIG. 8B depicts an image obtained when a jetting timing is not adjusted to compensate for an inclination of each nozzle array, FIG. 8C depicts an image obtained when the jetting timing is adjusted to compensate for the inclination of each nozzle array.

DESCRIPTION OF THE EMBODIMENTS

The following describes embodiments of the present teaching.

<Overall Structure of Ink-Jet Printer>

Figure 1:
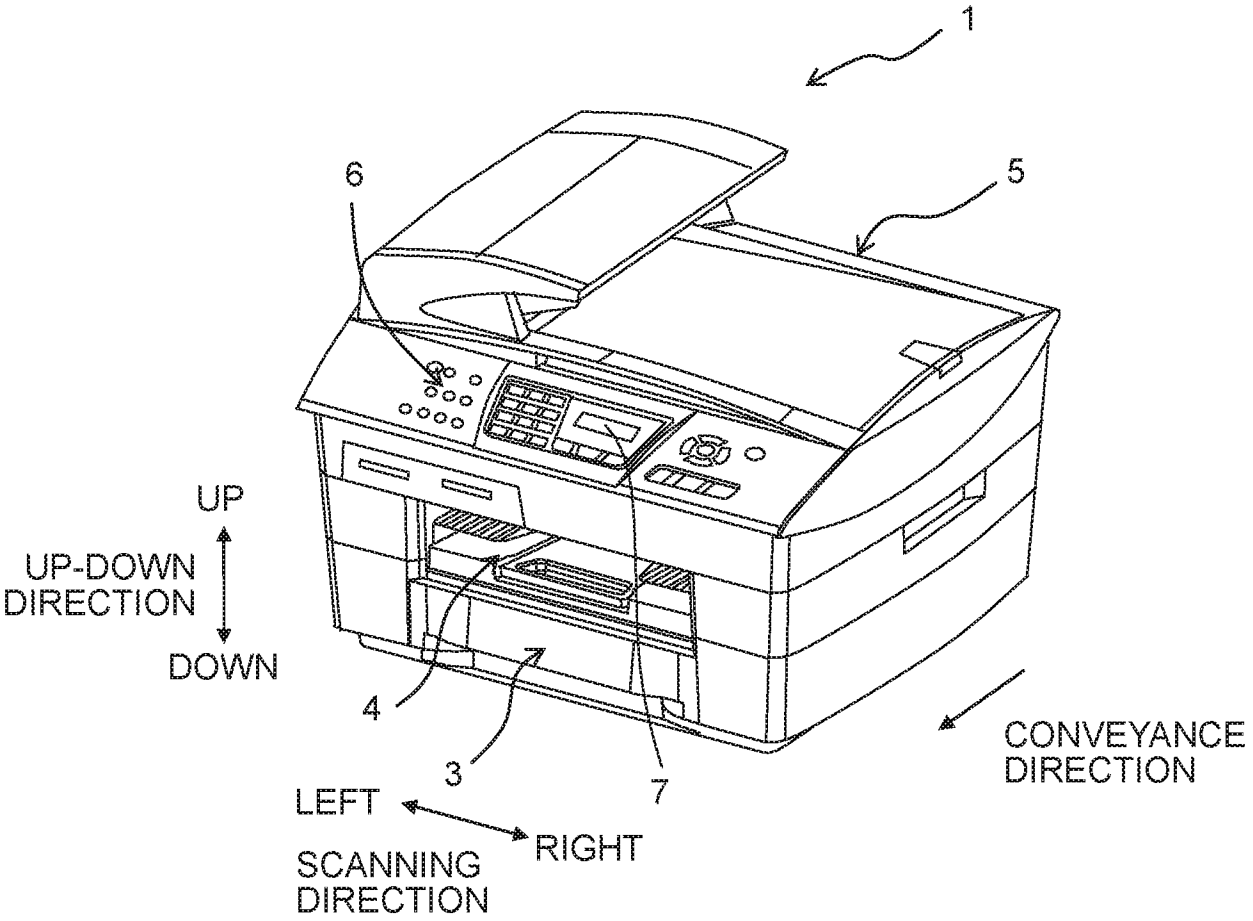
FIG. 1 is a schematic configuration diagram of a printer according to an embodiment of the present teaching.

A printer 1 according to the present embodiment ("a printer" of the present teaching) is a so-called multifunction peripheral that may perform printing on a recording sheet S, read an image, and the like. As depicted in FIG. 1, the printer 1 includes a printing unit 2 (see FIG. 2), a feed part 3, a discharge part 4, a reading unit 5, an operation unit 6, a display 7, and the like. A controller 50 (see FIG. 3) controls operations of the printer 1.

The printing unit 2 provided in the printer 1 performs printing on the recording sheet S. Details of the printing unit 2 will be described later. The feed part 3 feeds the recording sheet S to the printing unit 2. The recording sheet S for which printing has been performed by the printing unit 2 is discharged on the discharge part 4. The reading unit 5, which may be a scanner, reads a document. The operation unit 6 includes buttons and the like, and the user operates buttons of the operation unit 6 to cause the printer 1 to perform necessary operations. The display 7, which may be a liquid crystal display, displays necessary information when the printer 1 is being used.

<Printing Unit>

Figure 2:
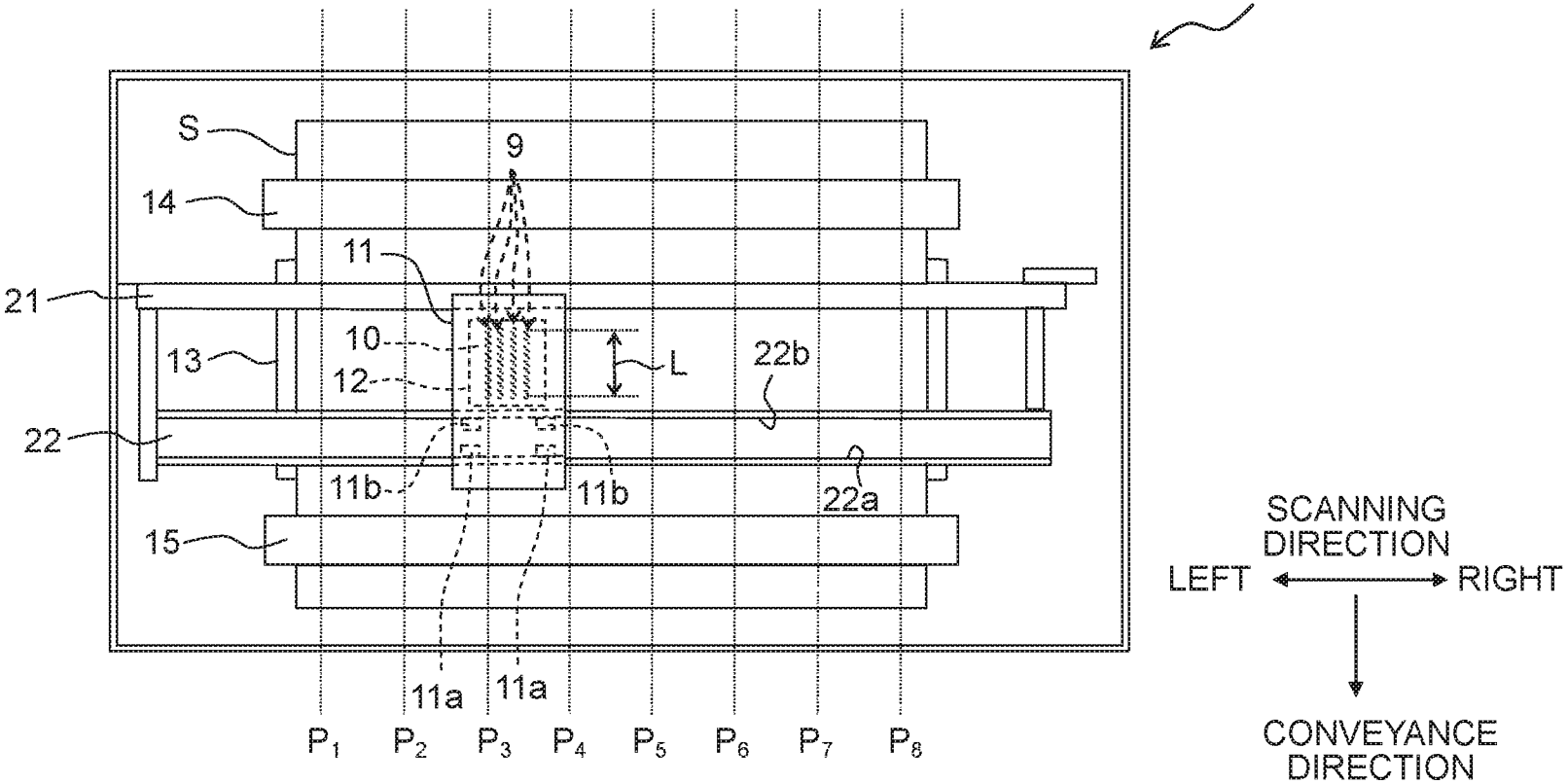
FIG. 2 is a schematic configuration diagram of a printing unit.

Subsequently, the printing unit 2 will be explained. As depicted in FIG. 2, the printing unit 2 includes a carriage 11, an ink-jet head 12, a platen 13, conveyance rollers 14 and 15, and the like.

The carriage 11 is supported by two guide rails 21 and 22 extending in a scanning direction. Of the two guide rails 21 and 22, the guide rail 22 ("a guide" of the present teaching) disposed downstream in a conveyance direction orthogonal to the scanning direction is formed with guide surfaces 22*a* and 22*b* at both ends in the conveyance direction. The guide surfaces 22*a* and 22*b* are provided to stand in a vertical direction and extend in the scanning direction. Meanwhile, the carriage 11 includes two contact parts 11*a* that are in contact with the guide surface 22*a* and two contact parts 11*b* that are in contact with the guide surface 22*b*. The carriage 11 is connected to a carriage motor 56 (see FIG. 3) via an unillustrated endless belt or the like. When the carriage motor 56 is driven, the carriage 11 is moved in the scanning direction while being guided by the guide surfaces 22*a* and 22*b* sliding with the contact parts 11*a* and 11*b*, respectively. In the present embodiment, a combination of the carriage motor 56, the unillustrated belt connecting the carriage motor 56 and the carriage 11, and the like corresponds to a carriage moving unit of the present teaching. The following explanation will be made by defining a right side and a left side in the scanning direction as depicted in FIG. 1.

The printer 1 includes an encoder 58 (see FIG. 3) detecting a position of the ink-jet head 12 in the scanning direction. The encoder 58 is a well-known device, and thus any detailed explanation therefore will be omitted. For example, the encoder 58 includes an encoder belt (not depicted) provided in any of the guide rails 21 and 22 and an encoder sensor (not depicted) provided in the carriage 11.

The ink-jet head 12 carried on the carriage 11 jets ink from nozzles 10 formed on a lower surface of the ink-jet head 12. The nozzles 10 are arrayed in the conveyance direction to form each nozzle array 9 having a length L not less than 1.2 inches. The ink-jet head 12 is formed with four nozzle arrays 9 arranged in the scanning direction. A black ink is jetted from the nozzles 10 of the rightmost nozzle array 9, a yellow ink is jetted from the nozzles 10 of the second rightmost nozzle array 9, a cyan ink is jetted from the nozzles 10 of the third rightmost nozzle array 9, and a magenta ink is jetted from the nozzles 10 of the leftmost nozzle array 9. Each of the inks is jetted from all the nozzles 10 forming the corresponding one of the nozzle arrays 9 at the same timing. Or, each of the nozzle arrays 9 may be divided into two or more groups including nozzles 10 arrayed in the conveyance direction. In that configuration, ink may be jetted from the nozzles 10 forming the same group at the same timing and ink may be jetted from the nozzles 10 forming different groups at different timings.

The platen 13 extending in the scanning direction is disposed to face the ink-jet head 12 below the ink-jet head 12. The platen 13 supports the recording sheet S from below. The conveyance rollers 14 and 15 are disposed upstream and downstream of the platen 13 in the conveyance direction, respectively. A conveyance motor 57 (see FIG. 3) rotates and drives the conveyance rollers 14 and 15 to convey the recording sheet S supported by the platen 13 in the conveyance direction. A combination of the conveyance rollers 14, 15 and the conveyance motor 57 corresponds to a conveyance unit of the present teaching.

<Controller>

Figure 3:
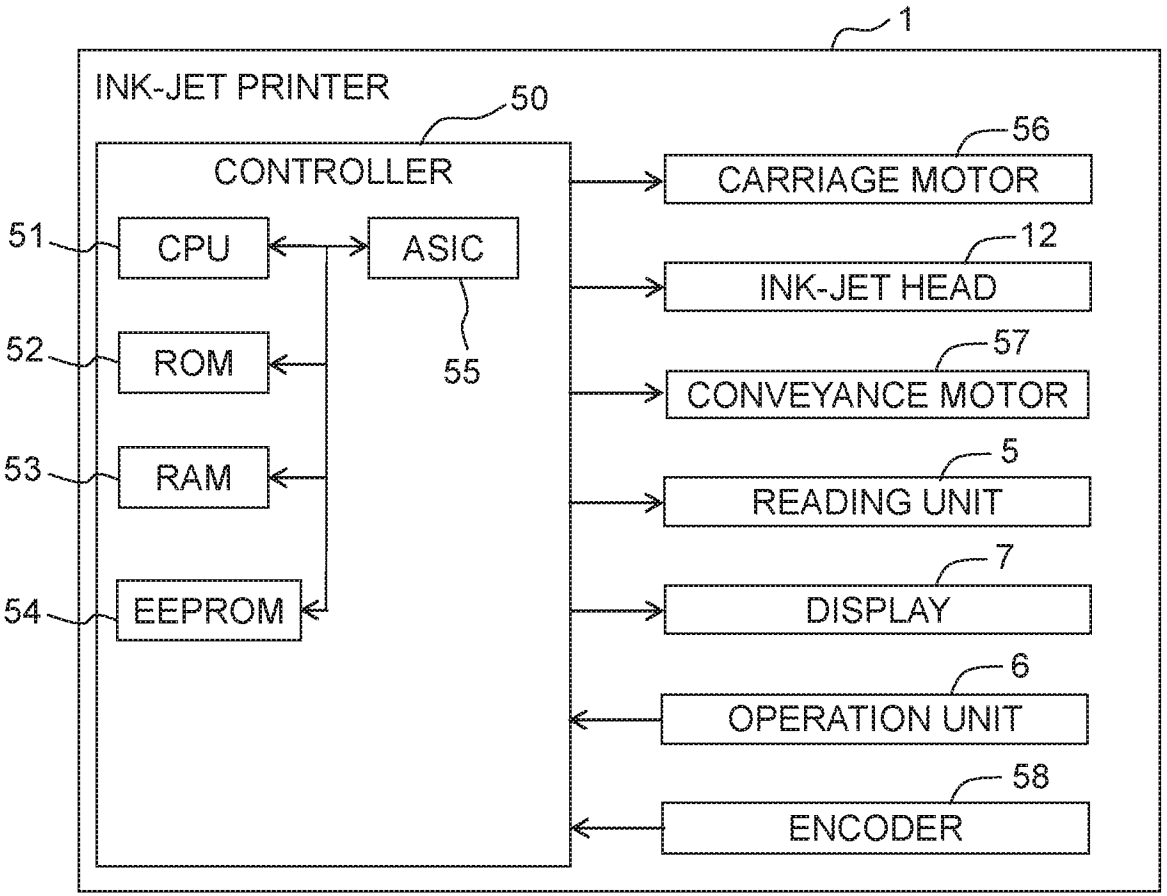
FIG. 3 is a block diagram depicting an electrical configuration of the printer.

The controller 50 controls operations of the printer 1. As depicted in FIG. 3, the controller 50 includes a Central Processing Unit (CPU) 51, a Read Only Memory (ROM) 52, a Random Access Memory (RAM) 53, an Electrically Erasable Programmable Read Only Memory (EEPROM) 54, an Application Specific Integrated Circuit (ASIC) 55, and the like. The controller 50 controls operations of the carriage motor 56, ink-jet head 12, conveyance motor 57 of the printing unit 2, the reading unit 5, the display 7, and the like. A signal in response to a user's command input through the operation unit 6 is input to the controller 50, and a signal indicating a position of the ink-jet head 12 is input from the encoder 58.

The controller 50 may include the single CPU 51, as depicted in FIG. 3, to make the CPU 51 perform processing collectively, or the controller 50 may include a plurality of CPUs 51 to make the CPUs 51 perform processing in a shared manner. The controller 50 may include the single ASIC 55, as depicted in FIG. 3, to make the ASIC 55 perform processing collectively, or the controller 50 may include a plurality of ASICs 55 to make the ASICs 55 perform processing in a shared manner <Control in Printing>

Figure 4:
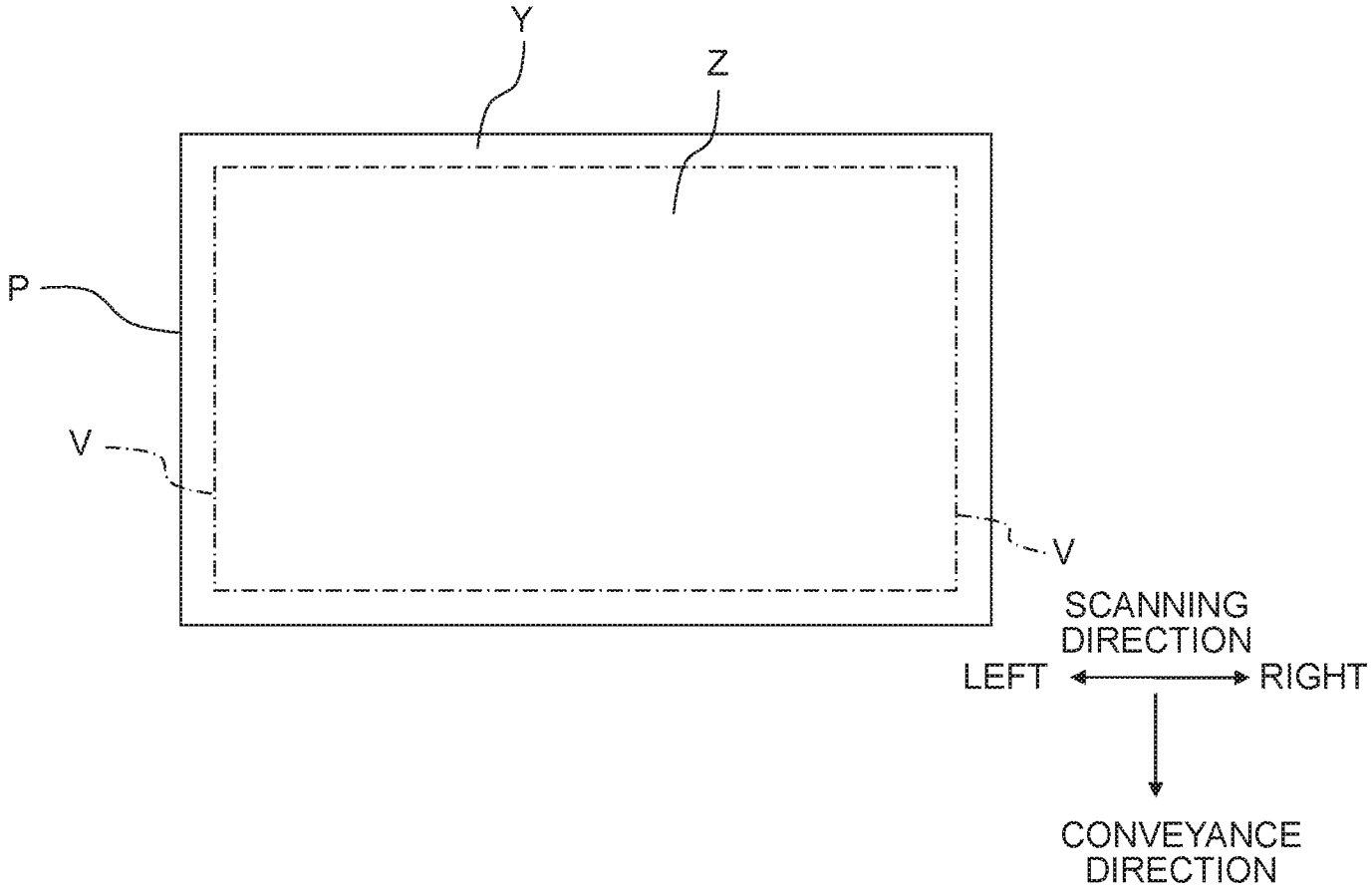
FIG. 4 illustrates a printing mode with a margin left.

Subsequently, a method of causing the printer 1 to perform printing on the recording sheet S by control of the controller 50 will be described. As depicted in FIG. 4, the printer 1 may perform printing by a printing mode with a margin left. In such a printing mode, a margin Y for which image printing is not allowed is set in the edge of the recording sheet S to perform printing only on a printing area Z inside the margin Y. The printer 1 performs printing on the recording sheet S by alternately and repeatedly performing scan printing and a conveyance operation. In the scan printing, the controller 50 controls the ink-jet head 12 to jet ink from the nozzles 10 while moving the carriage 11 rightward or leftward in the scanning direction. In the conveyance operation, the controller 50 controls the conveyance rollers 14 and 15 to convey the recording sheet S in the conveyance direction.

Figure 5A:
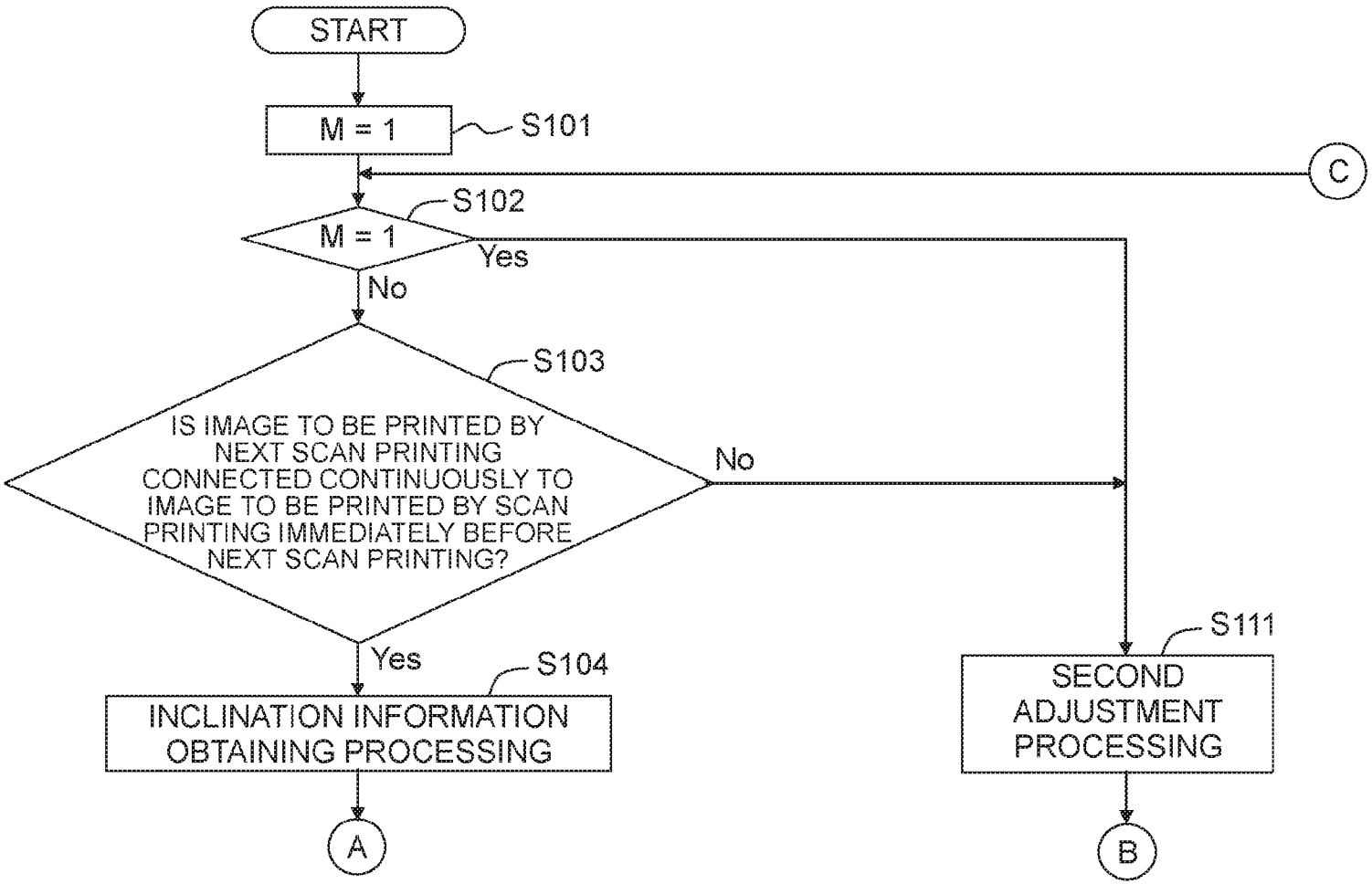
FIGS. 5A and 5B are flowcharts that indicate processing caused when the printer performs printing.
Figure 5B:
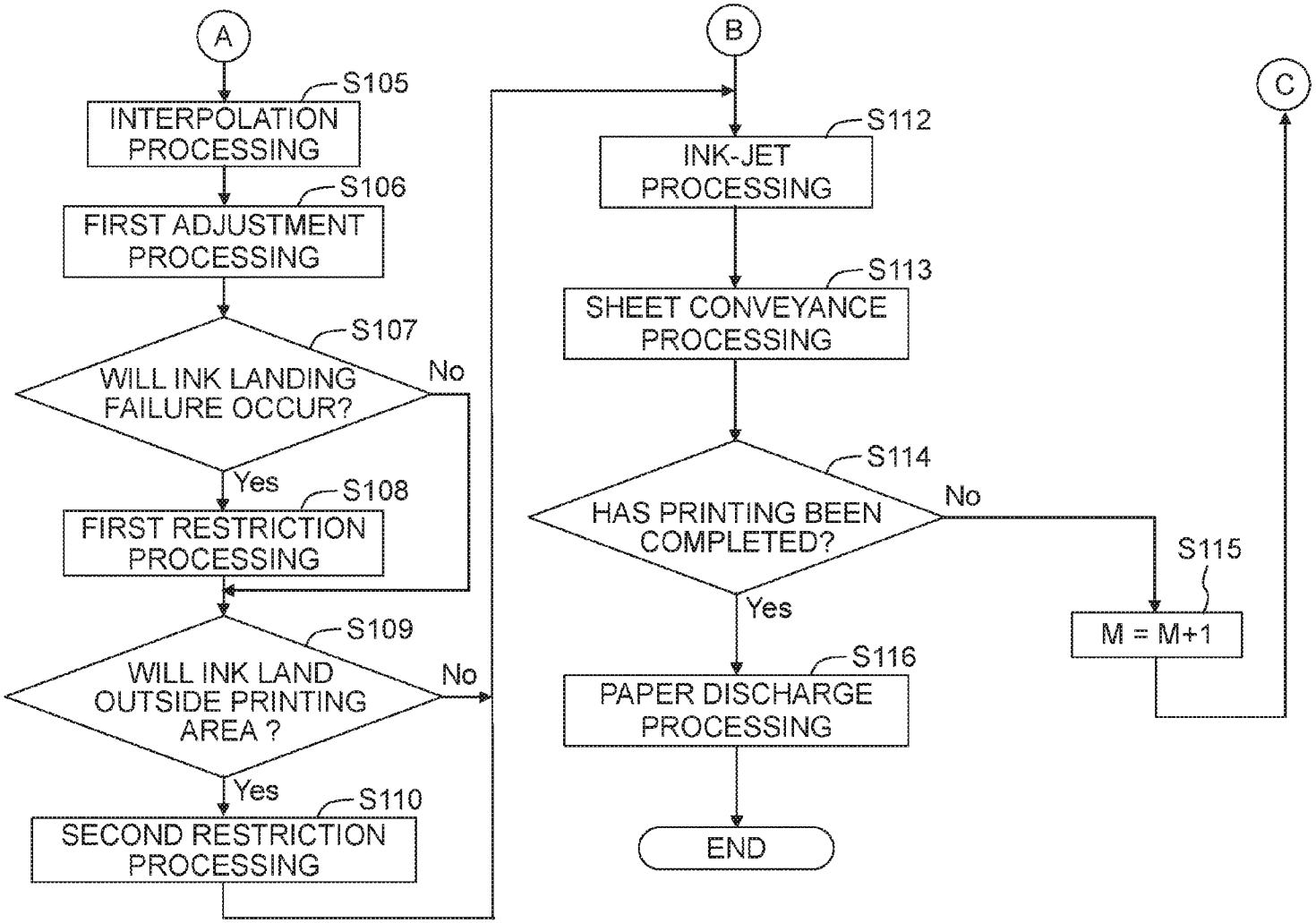

More specifically, the controller 50 executes processing in accordance with the flowchart of FIG. 5 when printing data has been input to the printer 1, so that the printer 1 performs printing on the recording sheet S. In the processing, the controller 50 resets a value of a variable M to 1 (S101). The value of the variable M is determined based on order (printing order) of scan printing to be performed next.

Figure 9A:
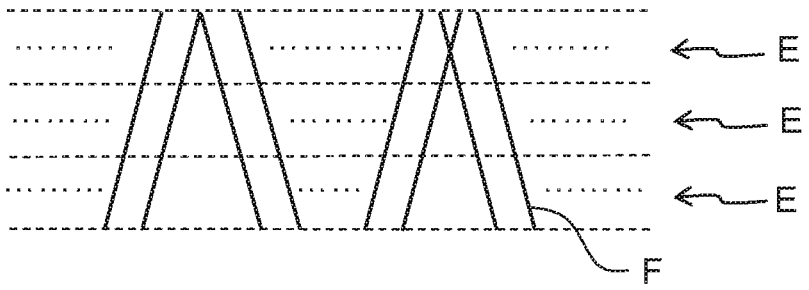
FIG. 9A illustrates a case in which an ink landing failure has occurred.

When the value of the variable M is 1 (S102: YES), the controller 50 executes a step S111 that will be described later. When the value of the variable M is 2 or greater (S102: NO), the controller 50 determines whether an image E (see FIG. 9) to be printed by the next scan printing is connected continuously to an image E to be printed by scan printing immediately before the next scan printing (hereinafter referred to as the last scan printing) (S103, referred to as third determination processing). In the step S103, the controller 50 determines whether a blank space D (see FIG. 9) for which no image is to be printed is present between the image E (see FIG. 9) to be printed by the next scan printing and the image E to be printed by the last scan printing, based on, for example, printing data. Or, in the step S103, the controller 50 determines, for example, whether the conveyance amount of the recording sheet S in the last conveyance operation exceeds a predefined amount (e.g., the length L of each nozzle array 9 in the conveyance direction).

When the image E to be printed by the next scan printing is not connected continuously to the image E to be printed by the last scan printing (S103: NO), the controller 50 executes the step S111. When the image E to be printed by the next scan printing is connected continuously to the image E to be printed by the last scan printing (S103: YES), the controller 50 executes, in a step S104, processing of obtaining inclination information (hereinafter referred to as inclination information obtaining processing).

Figure 6A:
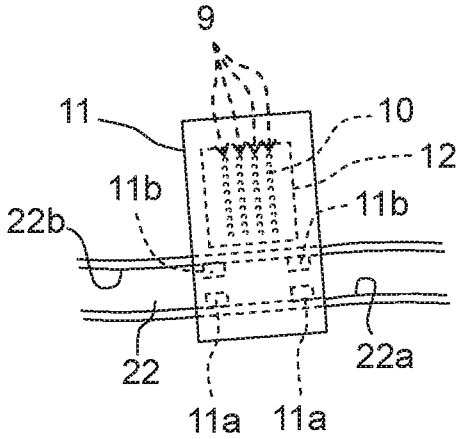
FIG. 6A depicts a state in which each nozzle array is inclined rightward due to a deformation of guide rails.
Figure 6B:
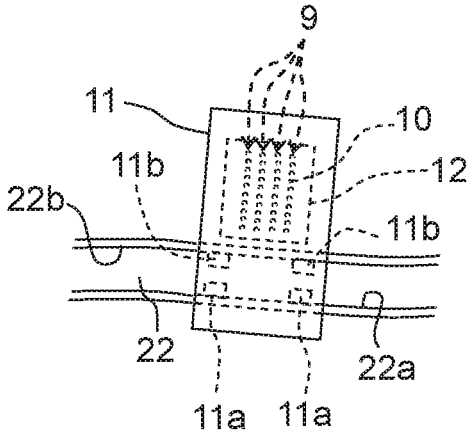
FIG. 6B depicts a state in which each nozzle array is inclined leftward due to a deformation of guide rails.
Figure 6B:
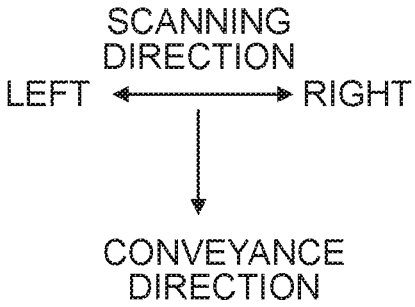

Here, in the printer 1, the guide rails 21 and 22 may be slightly deformed at the time of formation thereof or assembling them on the printer 1. In such a case, for example, as depicted in FIGS. 6A and 6B, the deformation of the guide rails 21 and 22 causes the carriage 11, which moves in the scanning direction while being guided by the guide surfaces 22*a* and 22*b* sliding with the contact parts 11*a* and 11*b*, to incline within a horizontal plane (a plane parallel to the scanning direction and the conveyance direction). The inclination of the carriage 11 in the horizontal plane causes each nozzle array 9 of the ink-jet head 12 carried on the carriage 11 to incline to the conveyance direction. The guide rail 22 may be deformed in various forms depending on positions in the scanning direction. In that case, the direction and extent of inclination of each nozzle array 9 with respect to the conveyance direction during movement of the carriage 11 in the scanning direction depend on the position in the scanning direction.

In the following, for convenience of description, a state as depicted in FIG. 6A in which each nozzle array 9 is inclined such that the most downstream nozzle 10 in the conveyance direction is positioned on the right of the most upstream nozzle 10 will be expressed as "each nozzle array 9 is inclined rightward". Further, a state as depicted in FIG. 6B in which each nozzle array 9 is inclined such that the most downstream nozzle 10 in the conveyance direction is positioned on the left of the most upstream nozzle 10 will be expressed as "each nozzle array 9 is inclined leftward".

Figure 7:
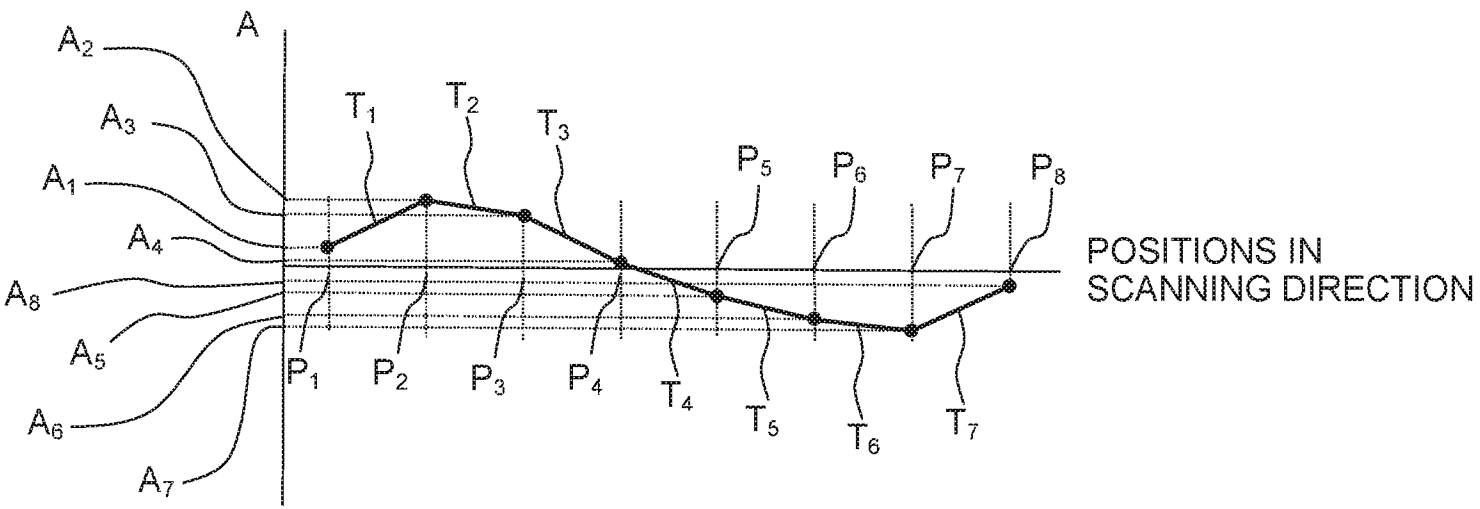
FIG. 7 illustrates inclination information and interpolation information.

In the present embodiment, as depicted in FIG. 7, values of a parameter A ("inclination information" of the present teaching) are previously stored in the EEPROM 54. The values of a parameter A indicate inclinations of each nozzle array 9 with respect to the conveyance direction due to deformations of the guide rail 22 at eight positions $P_1$ to $P_8$ apart from each other in the scanning direction. For example, the parameter A has a positive value in a state where each nozzle array 9 is inclined rightward, and the parameter A has a negative value in a state where each nozzle array 9 is inclined leftward. Regarding the value of the parameter A, the absolute value of the parameter A may increase, as the inclination of each nozzle array 9 with respect to the conveyance direction is greater. In the inclination information obtaining processing executed in the step S104, the controller 50 reads values of the parameter A at the positions $P_1$ to $P_8$ from the EEPROM 54. In the following, the values of the parameter A at the positions $P_1$ to $P_8$ will be referred to as values $A_1$ to $A_8$, respectively. The number of positions corresponding to values of the parameter A stored in the EEPROM 54 is not limited to eight. For example, values of the parameter A corresponding to seven or smaller positions or nine or greater positions may be stored in the EEPROM 54.

Subsequently, the controller 50 executes interpolation processing (S105). In the interpolation processing, the controller 50 generates interpolation information for performing interpolation of pieces of inclination information of inclinations of each nozzle array 9 at positions between the positions $P_1$ to $P_8$ in the scanning direction, based on the values $A_1$ to $A_8$ of the parameter A corresponding to the positions $P_1$ to $P_8$. As depicted in FIG. 7, the interpolation information is, for example, information of a function indicating a straight line $T_n$, which connects coordinates $[P_n, A_n]$ and coordinates $[P_{n+1}, A_{n+1}]$ (n=1, 2, . . . , 6, 7) on a plane in which a horizontal axis indicates positions in the scanning direction and a vertical axis indicates values of the parameter A. Or, the interpolation information may be, for example, information of a function indicating a curved line, which connects coordinates $[P_n, A_n]$ and coordinates $[P_{n+1}, A_{n+1}]$.

Figure 8A:
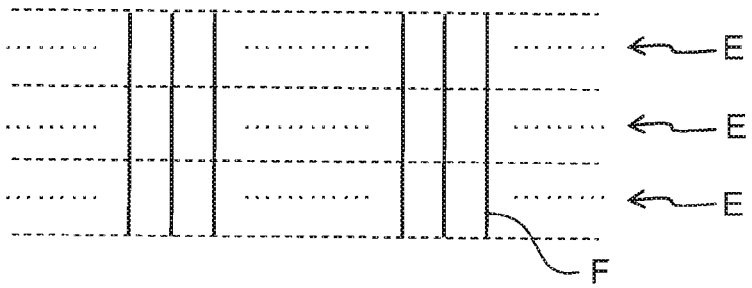
Figure 8B:
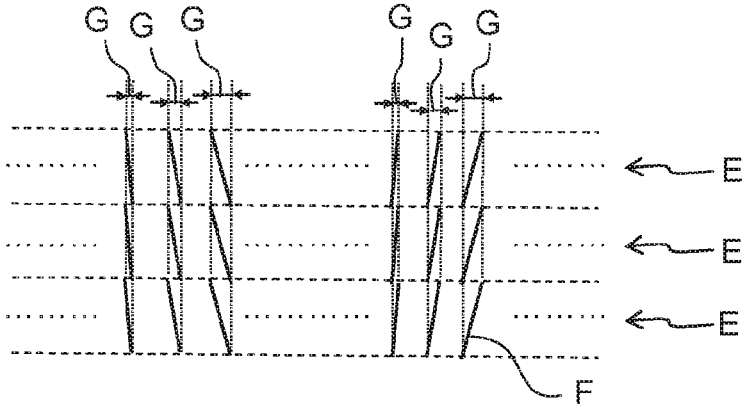

Subsequently, the controller 50 executes first adjustment processing (S106). As described above, when each nozzle array 9 is inclined to the conveyance direction, dots supposed to be arranged in the conveyance direction on the recording sheet S will be arranged in a direction inclined to the conveyance direction during scan printing for jetting ink from nozzles 10. Thus, if ink is jetted from nozzles 10 during scan printing at the jetting timing of when each nozzle array 9 is regarded as being parallel to the conveyance direction (hereinafter referred to as a reference timing in some cases), the following problem may occur. For example, as depicted in FIG. 8B, each seam between an image E to be printed by scan printing and an image E to be printed by scan printing immediately before the scan printing is shifted in the scanning direction, which makes it impossible to obtain an image as depicted in FIG. 8A. In such a case, a shift amount G of the seam increases, as the inclination of each nozzle array 9 with respect to the conveyance direction is greater. In FIGS. 8A, 8B, and the like, for easy understanding of the shift of ink landing positions caused by the inclination of each nozzle array 9, each image E is depicted as an image extending in the conveyance direction and formed by straight lines F arranged in the scanning direction. Broken lines in FIG. 8A, FIG. 8B, and the like indicate end positions of the images E in the conveyance direction.

When an image E to be printed by the next scan printing is made to be connected continuously to an image E to be printed by the last scan printing, the shift of the seam between the images E in the scanning direction will be conspicuous, thus greatly reducing image quality. In the present embodiment, the length L of each nozzle array 9 is 1.2 inches or greater, which is relatively long. Thus, when each nozzle array 9 is inclined, the shift amount in the scanning direction between the nozzles 10 disposed upstream in the conveyance direction and the nozzles 10 disposed downstream in the conveyance direction is large. Thus, when each nozzle array 9 is inclined, the shift amount G of the seam between the images E in the scanning direction is large.

In the present embodiment, in order to compensate for the inclination of each nozzle array 9 at each position in the scanning direction, the controller 50 adjusts, through the first adjustment processing, the jetting timing at each position in the scanning direction in scan printing so that the jetting timing adjusted deviates from the reference timing. In particular, the controller 50 adjusts the jetting timing at each of the positions $P_1$ to $P_8$ based on the corresponding one of values $A_1$ to $A_8$ of the parameter A. Further, the controller 50 adjusts the jetting timing at each position between the position $P_n$ and the position $P_{n+1}$ based on the value of the parameter A at each position obtained from interpolation information.

The relation between the value of the parameter A and the deviation amount of the jetting timing will be explained. When each nozzle array 9 is inclined rightward ($A_n>0$) during leftward movement of the carriage 11 in scan printing, the controller 50 adjusts the jetting timing so that the jetting timing adjusted is delayed relative to the reference timing. When each nozzle array 9 is inclined leftward ($A_n<0$), the controller 50 adjusts the jetting timing so that the jetting timing adjusted is advanced relative to the reference timing.

When each nozzle array 9 is inclined rightward ($A_n>0$) during rightward movement of the carriage 11 in scan printing, the controller 50 adjusts the jetting timing so that the jetting timing adjusted is advanced relative to the reference timing. When each nozzle array 9 is inclined leftward ($A_n<0$), the controller 50 adjusts the jetting timing so that the jetting timing adjusted is delayed relative to the reference timing.

The controller 50 may adjust the jetting timing so that the jetting timing adjusted deviates from the reference timing more greatly as the absolute value of the parameter A increases. Or, the controller 50 may adjust the jetting timing so that the jetting timing adjusted deviates from the reference timing more greatly as the value of the variable M increases (the jetting timing adjusted deviates from the reference timing more greatly in later scan printing).

The jetting timing adjustment described above will be specifically explained. When each nozzle array 9 is inclined rightward during leftward movement of the carriage 11 in scan printing, the controller 50 delays the jetting timing in the second or succeeding scan printing relative to the jetting timing in scan printing immediately before the second or succeeding scan printing (hereinafter referred to as the last scan printing). The controller 50 may delay the jetting timing in the second or succeeding scan printing relative to the jetting timing in the last scan printing more greatly, as the inclination of each nozzle array 9 is greater. When each nozzle array 9 is inclined leftward, the controller 50 advances the jetting timing in the second or subsequent scan printing relative to the jetting timing in the last scan printing. The controller 50 may advance the jetting timing in the second or succeeding scan printing relative to the jetting timing in the last scan printing more greatly, as the inclination of each nozzle array 9 is greater.

When each nozzle array 9 is inclined rightward during rightward movement of the carriage 11 in scan printing, the controller 50 advances the jetting timing in the second or subsequent scan printing relative to the jetting timing in the last scan printing. The controller 50 may advance the jetting timing in the second or subsequent scan printing relative to the jetting timing in the last scan printing more greatly, as the inclination of each nozzle array 9 is greater. When each nozzle array 9 is inclined leftward, the controller 50 delays the jetting timing in the second or subsequent scan printing relative to the jetting timing in the last scan printing. The controller 50 may delay the jetting timing in the second or subsequent scan printing relative to the jetting timing in the last scan printing more greatly, as the inclination of each nozzle array 9 is greater.

Figure 8C:
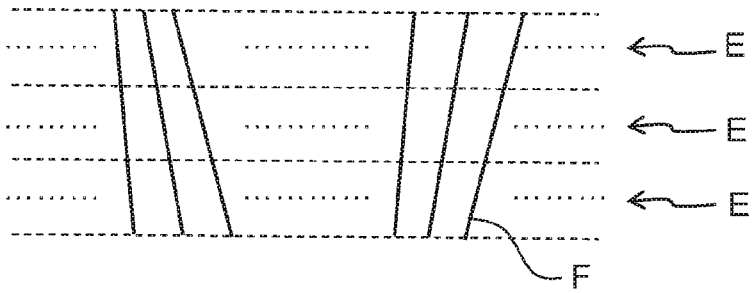
Figure 8C:
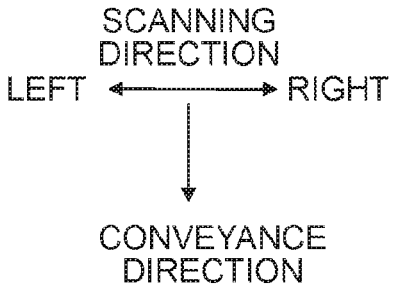

Thus, when each nozzle array 9 is inclined rightward, the jetting timing after adjustment in the second or subsequent scan printing may be a timing at which ink landing positions are shifted further leftward from ink landing positions in the last scan printing, as the inclination of each nozzle array 9 is greater. When each nozzle array 9 is inclined leftward, the jetting timing after adjustment may be a timing at which ink landing positions are shifted further rightward from ink landing positions in the last scan printing, as the inclination of each nozzle array 9 is greater. In the present embodiment, the jetting timing is adjusted by reflecting both the values $A_1$ to $A_8$ (inclination information) of the parameter A at the respective positions $P_1$ to $P_8$ and the last scan printing, as described above. Thus, jetting ink at the jetting timing after adjustment in scan printing may prevent the shift of the seam between the image E to be printed by the next scan printing and the image E to be printed by the last scan printing in the scanning direction, as depicted in FIG. 8C.

In the present embodiment, as described above, jetting timings at the positions $P_1$ to $P_8$ are adjusted based on the values $A_1$ to $A_8$ of the parameter A respectively, and the jetting timing at each position between the position $P_n$ and the position$_{n+1}$ is adjusted based on the value of the parameter A at each position obtained from interpolation information. Accordingly, the jetting timing at each position in the scanning direction may be adjusted appropriately. Further, in the present embodiment, the values $A_1$ to $A_8$ of the parameter A at the positions $P_1$ to $P_8$ are stored in the EEPROM 54. The value of the parameter A at each position between the position $P_n$ and the position $P_{n+1}$ is interpolated by interpolation information obtained from the value $A_n$ and the value $A_{n+1}$. Accordingly, the capacity of the EEPROM 54 may be reduced compared to a case in which values of the parameter A at all the positions in the scanning direction required for the jetting timing adjustment are individually stored in the EEPROM 54.

In the first adjustment processing, the jetting timing is also adjusted to compensate for the shift of ink landing positions caused by a factor other than the inclination of each nozzle array 9 within the horizontal plane. However, the jetting timing adjustment for compensating for the shift of ink landing positions caused by a factor other than the inclination of each nozzle array 9 within the horizontal plane is not related directly to characteristics of the present teaching. Thus, any detailed explanation therefore will be omitted.

After the first adjustment processing, the controller 50 determines whether ink landing failure occurs when ink is jetted from nozzles 10 at the jetting timing after adjustment of the first adjustment processing in scan printing (S107, referred to as first determination processing). The ink landing failure means, for example, a situation in which, landing positons of ink jetted at the latter timing, of two jetting timings continuously executed in scan printing, partially overlap with landing positions of ink jetted at the former timing (see FIG. 9A). Or, the ink landing failure means a situation in which landing positons of ink jetted at the latter timing are partially upstream of landing positions of ink jetted at the former jetting timing in the moving direction of the carriage 11. For example, each nozzle array 9 may be inclined leftward at the position corresponding to the former jetting timing and each nozzle array 9 may be inclined rightward at the position corresponding to the latter jetting timing. When the inclination of each nozzle array 9 greatly changes between the two jetting timings like this, the ink landing failure occurs. The ink landing failure causes portions (straight lines F) supposed to be separated from each other in the scanning direction to be seamed or connected in a printed image E, thus deteriorating image quality.

Figure 9B:
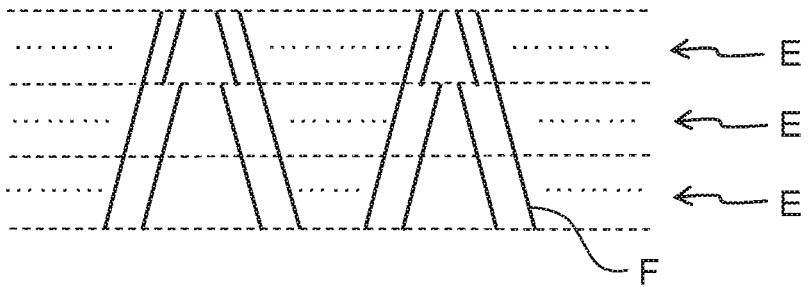
FIG. 9B illustrates a case in which an adjustment in first adjustment processing has been restricted by first restriction processing.
Figure 9B:
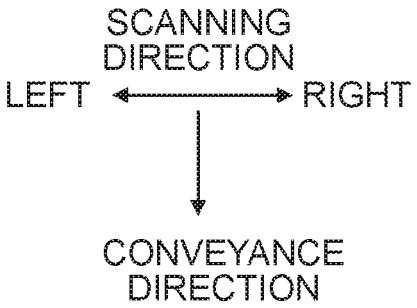

In order to that problem, the controller 50 executes first restriction processing (S108) when determining that the ink landing failure occurs (S107: YES). In the first restriction processing, the controller 50 restricts the jetting timing adjustment executed in the step S106 such that the adjustment for at least one of the two jetting timings is restricted (the time delaying the jetting timing is reduced or the time advancing the jetting timing is reduced). This adjusts the two jetting timings so that they are in a range not causing the ink landing failure, as depicted in FIG. 9B.

After the first restriction processing, the controller 50 executes a step S109. When the controller 50 has determined that no ink landing failure occurs (S107: NO), the controller executes the step S109.

Figure 10A:
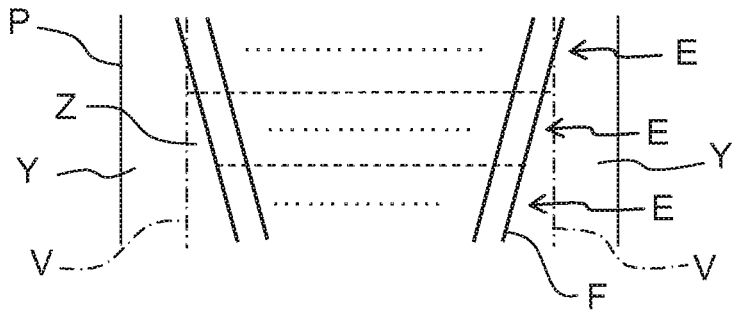
FIG. 10A illustrates a case in which ink has landed on a margin.

In the step S109, the controller 50 determines whether ink jetted from nozzles 10 at the jetting timing after adjustment in the first adjustment processing lands outside a boundary line V ("a limit position" of the present teaching) of the printing area Z and the margin Y in the scanning direction. Namely, the controller 50 determines whether the ink lands on the margin Y (referred to as second determination processing). When the first restriction processing has been executed, the jetting timing after the first restriction processing may be defined as "a jetting timing after adjustment in the first adjustment processing". Here, as depicted in FIG. 10A, each nozzle array 9 may be inclined rightward. In that case, when the jetting timing is adjusted by the first adjustment processing, landing positions of ink jetted in scan printing may be shifted leftward from landing positions of ink jetted in the last scan printing. This may cause the ink to land on the left-side margin Y. Meanwhile, each nozzle array 9 may be inclined leftward. In that case, when the jetting timing is adjusted by the first adjustment processing, landing positions of ink jetted in scan printing may be shifted rightward from landing positions of ink jetted in the last scan printing. This may cause the ink to land on the right-side margin Y.

Figure 10B:
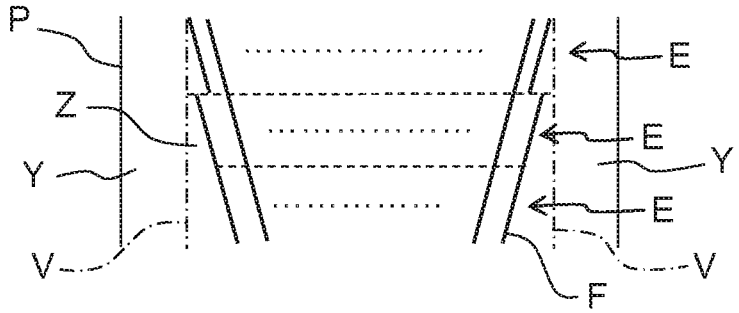
FIG. 10B illustrates a case in which the jetting timing adjustment in the first adjustment processing has been restricted by second restriction processing.
Figure 10B:
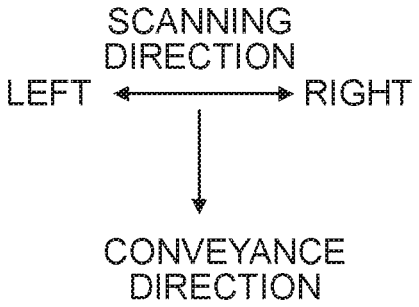

When the controller 50 has determined that the ink lands on the margin Y (S109: YES), the controller 50 executes second restriction processing (S110). In the second restriction processing, the controller 50 restricts the jetting timing adjustment executed in the step S106 (the time delaying the jetting timing is reduced or the time advancing the jetting timing is reduced) so that the jetting timing is adjusted to be in a range allowing ink to land only on the printing area Z (see FIG. 10B). This prevents an image to be printed from being printed on the margin Y beyond the printing area Z.

After the second restriction processing, the controller 50 executes a step S112. When the controller 50 has determined that no ink lands on the margin Y (S109: NO), the controller executes a step S112.

When M=1 is satisfied (S102: YES), the controller 50 executes the second adjustment processing (S111). In the second adjustment processing, the jetting timing is adjusted to compensate for the shift of ink landing positions caused by a factor other than the inclination of each nozzle array 9 within the horizontal plane. After the second adjustment processing, the controller 50 executes the step S112.

When the image E to be printed by the next scan printing is not connected continuously to the image E to be printed by the last scan printing (S103: NO), the controller 50 executes the second adjustment processing (S111) and then executes the step S112.

Figure 11:
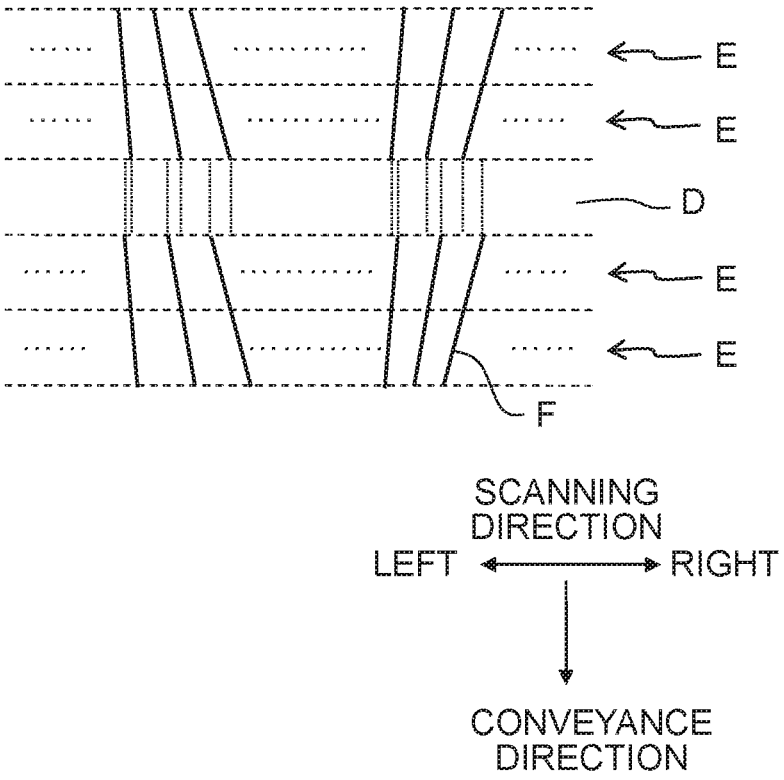
FIG. 11 illustrates a case in which an image to be printed by scan printing is not connected continuously to an image to be printed by scan printing immediately before the scan printing.

As depicted in FIG. 11, the image E to be printed by the next scan printing may not be connected continuously to the image E to be printed by the last scan printing due to the blank space D formed between the images E. In such a case, even when a downstream end, of the image E to be printed by the next scan printing, in the conveyance direction is shifted in the scanning direction from an upstream end, of the image E to be printed by the last scan printing, in the conveyance direction, the shift is inconspicuous and not likely to affect image quality. Thus, in the present embodiment, when the shift is inconspicuous, the jetting timing adjustment, such as that executed in the first adjustment processing of the step S106 for compensating for the inclination of each nozzle array 9, is not executed. This prevents unnecessary jetting timing adjustment in scan printing.

In the step S112, the controller 50 executes ink-jet processing in which scan printing is performed by controlling the ink-jet head 12 to jet ink from nozzles 10 while controlling the carriage motor 56 to move the carriage 11 rightward or leftward in the scanning direction. Here, the controller 50 controls the ink-jet head 12 to execute the ink-jet processing in which ink is jetted from nozzles 10 at the jetting timing adjusted in the steps S106, S108, and S110 or the jetting timing adjusted in the step S112. After the ink-jet processing, the controller 50 executes conveyance processing in which the conveyance operation is executed by controlling the conveyance motor 57 to convey the recording sheet S in the conveyance direction (S113).

Subsequently, the controller 50 determines whether printing has been completed based on printing data (S114). When the printing has not been completed (S114: NO), the controller 50 increases the value of the variable M by one (S115) and returns to the step S102. When the printing has been completed, the controller 50 executes paper discharge processing in which the controller 50 controls the conveyance motor 57 to convey the recording sheet S in the conveyance direction and discharge the recording sheet S on the discharge part 4 (S116). Then, the processing ends.

<Method of Obtaining Inclination Information>

In the present embodiment, as described above, the values $A_1$ to $A_8$ of the parameter A corresponding to the positions $P_1$ to $P_8$ respectively are stored in the EEPROM 54 in advance. A method of obtaining the values $A_1$ to $A_8$ of the parameter A stored in the EEPROM 54 will be described.

Figure 12:
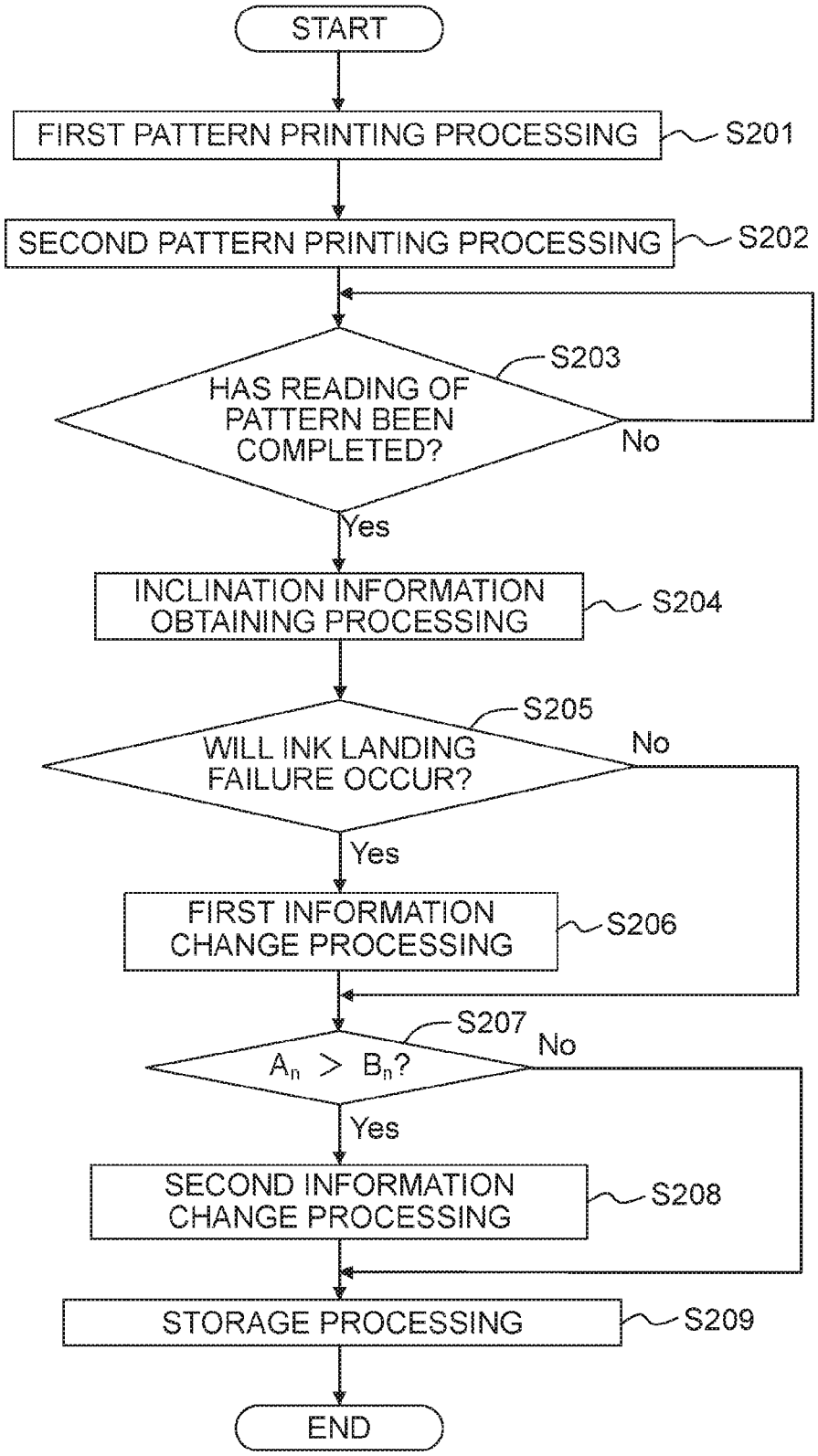
FIG. 12 is a flowchart indicating a method of obtaining inclination information stored in an EEPROM.
Figure 13A:
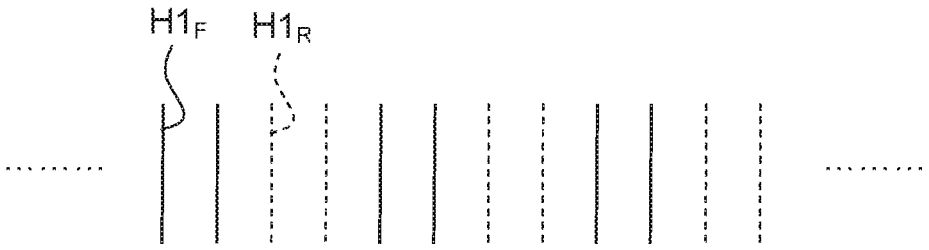
FIG. 13A depicts a state in which first linear patterns have been printed.

In order to determine the values $A_1$ to $A_8$ of the parameter A stored in the EEPROM 54, as depicted in FIG. 12, the controller 50 first executes first pattern printing processing (S201, referred to as a first pattern printing step). In the first pattern printing processing, first linear patterns $H1_F$ and $H1_R$ as depicted in FIG. 13A are printed on the recording sheet S.

More specifically, the controller 50 controls the ink-jet head 12 to jet ink from nozzles 10 disposed at an upstream side in the conveyance direction ("first nozzles" of the present teaching), the upstream nozzles 10 corresponding to about half of all the nozzles 10 belonging to each nozzle array 9, while controlling the carriage motor 56 to move the carriage 11 rightward in the scanning direction. Accordingly, the first linear patterns $H1_F$ arranged in the scanning direction are printed on the recording sheet S. Further, the controller 50 controls the ink-jet head 12 to jet ink from the first nozzles while controlling the carriage motor 56 to move the carriage 11 leftward in the scanning direction. Accordingly, the first linear patterns $H1_R$ arranged in the scanning direction are printed on the recording sheet S. In FIG. 13A, in order to distinguish the first linear patterns $H1_F$ from the first linear patterns $H1_R$, the first linear patterns $H1_F$ are depicted by solid lines and the first linear patterns $H1_R$ are depicted by broken lines.

The first linear patterns $H1_F$ and $H1_R$ are parallel to the conveyance direction when each nozzle array 9 is parallel to the conveyance direction. In the step S201, for example, the first linear patterns $H1_F$ and $H1_R$ are printed such that two first linear patterns $H1_F$ and two first linear patterns $H1_R$ are alternately arranged in the scanning direction, as depicted in FIG. 13A.

Figure 13B:
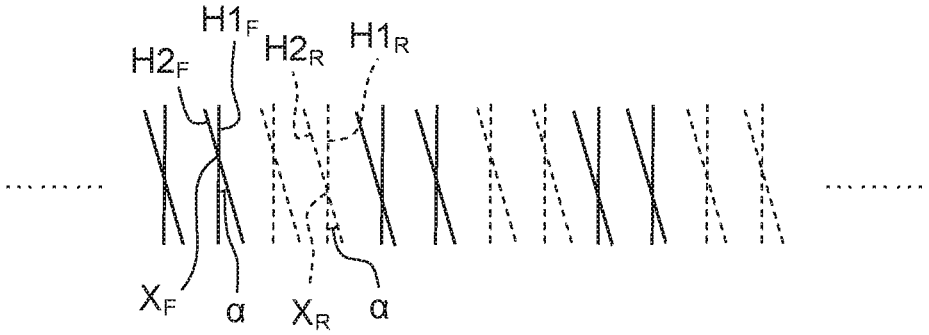
FIG. 13B depicts a state in which second linear patterns have been printed such that they are superposed on the first linear patterns.

Subsequently, as depicted in FIG. 13B, the controller 50 executes second pattern printing processing (S202, referred to as a second pattern printing step). In the second pattern printing step, second linear patterns $H2_F$ and $H2_R$ which partially overlap with the first linear patterns $H1_F$ and $H1_R$ are printed on the recording sheet S.

More specifically, the controller 50 controls the conveyance motor 57 to convey the recording sheet S in the conveyance direction by about half the length of the length L of each nozzle array 9. Then, the controller 50 controls the ink-jet head 12 to jet ink from nozzles 10 disposed at a downstream side in the conveyance direction (second nozzles of the present teaching), the downstream nozzles 10 corresponding to about remaining half of all the nozzles 10 belonging to each nozzle array 9, while controlling the carriage motor 56 to move the carriage 11 rightward in the scanning direction. Accordingly, the second linear patterns $H2_F$ intersecting with the first linear patterns $H1_F$ are printed on the recording sheet S. Further, the controller 50 controls the ink-jet head 12 to jet ink from the second nozzles while controlling the carriage motor 56 to move the carriage 11 leftward in the scanning direction. Accordingly, the second linear patterns $H2_R$ intersecting with the first linear patterns $H1_R$ are printed on the recording sheet S. The second linear patterns $H2_F$ and $H2_R$ are inclined to the first linear patterns $H1_F$ and $H1_R$ by a predefined angle $\alpha$. In FIG. 13B, in order to distinguish the second linear patterns $H2_F$ from the second linear patterns $H2_R$, the second linear patterns $H2_F$ are depicted by solid lines and the second linear patterns $H2_R$ are depicted by broken lines.

In the steps S201 and S202, the controller 50 controls the ink-jet head 12 to jet ink from nozzles 10 at the reference timing, thus printing the linear patterns $H1_F$, $H1_R$, $H2_F$, and $H2_R$.

Then, the user makes the reading unit 5 read the printed linear patterns $H1_F$, $H1_R$, $H2_F$, and $H2_R$. The controller 50 waits until reading of the linear patterns $H1_F$, $H1_R$, $H2_F$, and $H2_R$ by the reading unit 5 has been completed (S203: NO). When reading of the linear patterns $H1_F$, $H1_R$, $H2_F$, and $H2_R$ by the reading unit 5 has been completed (S203: YES), the controller 50 executes processing of obtaining inclination information (S204, hereinafter referred to as inclination information obtaining processing) in which values $A_1$ to $A_8$ (inclination information) of the parameter A at the positions $P_1$ to $P_8$ are obtained based on the reading result of the reading unit 5 (S204, referred to as an inclination information obtaining step).

Figure 13C:
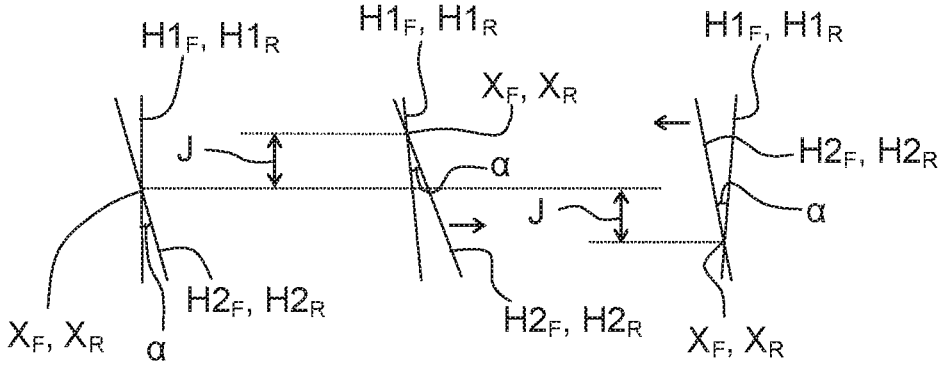
FIG. 13C illustrates relations between nozzle array inclinations and positions of intersection points of the linear patterns.

Here, as depicted in FIG. 13C, when each nozzle array 9 is parallel to the conveyance direction, for example, a middle point of each of the linear patterns $H1_F$ and $H2_F$ is an intersection point $X_F$ of the first linear pattern $H1_F$ and the second linear pattern $H2_F$, and a middle point of the linear patterns $H1_R$ and $H2_R$ is an intersection point $X_R$ of the first linear pattern $H1_R$ and the second linear pattern $H2_R$.

When each nozzle array 9 is inclined rightward, the second nozzles to be used for printing of the second linear patterns $H2_F$ and $H2_R$ are shifted rightward in the scanning direction relative to the first nozzles to be used for printing of the first linear patterns $H1_F$ and $H1_R$. Thus, compared to a case in which each nozzle array 9 is parallel to the conveyance direction, the second linear patterns $H2_F$ and $H2_R$ are shifted rightward relative to the first linear patterns $H1_F$ and $H1_R$, and the intersection points $X_F$ and $X_R$ are shifted upstream in the conveyance direction. Similarly, when each nozzle array 9 is inclined leftward, compared to the case in which each nozzle array 9 is parallel to the conveyance direction, the second linear patterns $H2_F$ and $H2_R$ are shifted leftward relative to the first linear patterns $H1_F$ and $H1_R$, and the intersection points $X_F$ and $X_R$ are shifted downstream in the conveyance direction. The shift amount J of the intersection points $X_F$ and $X_R$ in the conveyance direction increases as the inclination of each nozzle array 9 with respect to the conveyance direction increases.

Thus, in the step S204, the controller 50 obtains the values $A_1$ to $A_8$ of the parameter A based on positions of the intersection points $X_F$ and $X_R$ in the conveyance direction. On that occasion, when the intersection points $X_F$ and $X_R$ are shifted upstream in the conveyance direction, the value $A_n$ of the parameter A to be obtained is a positive value. When the intersection points $X_F$ and $X_R$ are shifted downstream in the conveyance direction, the value $A_n$ of the parameter A to be obtained is a positive value. The value $A_n$ of the parameter A to be obtained increases as the shift amount J increases.

In the step S204, for example, the controller 50 obtains the value $A_n$ of the parameter A at the position $P_n$ based on an average position of four positions in all: positions of two intersection points $X_F$ closest to the position $P_n$ (n=1, 2, . . . , 7, 8) in the conveyance direction and positions of two intersection points $X_R$ closest to the positon $P_n$ in the conveyance direction.

Subsequently, the controller 50 determines whether any scan printing will have the ink landing failure after the jetting timing adjustment is executed in the first adjustment processing of the step S106, based on the values $A_1$ to $A_8$ of the parameter A obtained in the step S204 (S205, referred to as a first determination step). In the step S205, the controller 50 determines that the ink landing failure occurs, for example, when an absolute value $|A_{n+1}-A_n|$ of the difference between the values $A_n$ and $A_{n+1}$ of the parameter A obtained in the step S204 exceeds a predefined threshold value Am.

When the controller 50 has determined that any scan printing will have the ink landing failure (S205: YES), the controller 50 executes first information change processing for changing the value of the parameter A so that the absolute value of the parameter A at a position corresponding to at least one of the two jetting timings causing the ink landing failure is made to be smaller (S206, referred to as a first information change step). In the step S206, for example, when the controller 50 has determined in the step S205 that the absolute value $|A_{n+1}-A_n|$ exceeds the predefined threshold value Am, the controller 50 changes one of the values $A_n$ and $A_{m+1}$ of the parameter A to make the absolute value $|A_{n+1}-A_n|$ the threshold value Am or smaller.

Here, in the present embodiment, the controller 50 also executes the jetting timing adjustment for compensating for the shift of ink landing positions caused by a factor other than the inclination of each nozzle array 9, in the first adjustment processing of the step S106. Thus, even when the value of the parameter A has been changed in the step S206, the ink landing failure may occur when ink is jetted at the jetting timing after adjustment in the first adjustment processing. This means that the first restriction processing of the step S108 is meaningful even after the first information change processing is executed in the step S206. When the first information change processing has been executed in the step S206, frequency of the ink landing failure caused when ink is jetted at the jetting timing after adjustment in the first adjustment processing will be reduced, compared to a case in which the first information change processing is not executed. This may reduce the number of times of the first restriction processing of the step S108.

After the first information change step, the controller 50 executes a step S207. When the controller 50 has determined that no scan printing has ink landing failure (S205: NO), the controller executes the step S207.

In the step S207, the controller 50 determines whether an absolute value $|A_n|$ of the parameter A for each of the positions $P_n$ (n=1, 2, . . . , 7, 8) exceeds a predefined value $B_n$. The predefined value $B_n$ is the absolute value of the parameter A obtained when the inclination angle of each nozzle array 9 with respect to the conveyance direction is a predefined angle $\beta_n$. The predefined value $B_n$ (predefined angle $\beta_n$) is smaller toward outside positions in the scanning direction. Namely, the relations of $B_1<B_2<B_3<B_4$ and $B_5>B_6>B_7>B_8$ are satisfied (the relations of $\beta_1<\beta_2<\beta_3<\beta_4$ and $\beta_5>\beta_6>\beta_7>\beta_8$ are satisfied).

When the absolute value $|A_n|$ of the parameter A exceeds the predefined value $B_n$ (S207: YES), the controller 50 executes second information change processing for changing the value An of the parameter A into a value making the absolute value $|A_n|$ the predefined value $B_n$ or smaller (S208, referred to as a second information change step). Regarding how to determine the threshold value Am and the predefined value $B_n$, the disclosure of U.S. Pat. No. 8,950,840 is incorporated herein by reference in its entirety.

The inclination of each nozzle array 9 with respect to the conveyance direction may be large. In that case, when the controller 50 adjusts the jetting timing at the position $P_n$ based on the value $A_n$ of the parameter A obtained in the step S204, ink may land on the margin Y during any scan printing, as described above. Thus, in the present embodiment, when the absolute value $|A_n|$ of the parameter A exceeds the predefined value $B_n$, the controller 50 changes the value An of the parameter A into a value making the absolute value $|A_n|$ the predefined value $B_n$ or smaller. This prevents ink from landing on the margin Y.

The ink is more likely to land on the margin Y in scan printing, as the inclination of each nozzle array 9 with respect to the conveyance direction is greater toward outside positions in the scanning direction. Thus, in the present embodiment, the controller 50 makes the predefined value $B_n$ smaller toward outside positions in the scanning direction. Accordingly, the ink may be prevented from landing on the margin Y at outside positions in the scanning direction without unnecessarily changing the value of the parameter A obtained in the step S204 at positions closer to the center side in the scanning direction.

In the present embodiment, in the first adjustment processing of the step S106, the controller 50 also executes the jetting timing adjustment for compensating for the shift of ink landing positions caused by a factor other than the inclination of each nozzle array 9. Thus, even when the value of the parameter A has been changed by the second information change processing of the step S208, ink jetted at the jetting timing after adjustment in the first adjustment processing may land on the margin Y. This means that the second restriction processing of the step S110 is meaningful even after the second information change processing is executed in the step S208. When the second information change processing has been executed in the step S208, the ink jetted at the jetting timing after adjustment in the first adjustment processing is less likely to land on the margin Y, compared to a case in which the second information change processing has not been executed. This may reduce the number of times of the second restriction processing of the step S110.

Then, the controller 50 executes storage processing for storing the values $A_1$ to $A_8$ of the parameter A adjusted by the processing of the steps S201 to S208, as inclination information, in the EEPROM 54 (S209).

Subsequently, modified embodiments in which various modifications are added to the present embodiment will be described.

In the above embodiment, the controller 50 determines whether ink jetted at the jetting timing adjusted by the first adjustment processing of the step S106 has landing failure (S107). When the controller 50 has determined that the ink landing failure occurs, the controller 50 executes the first restriction processing (S108). The present teaching, however, is not limited thereto. The controller 50 may not perform processing of the steps S107 and S108. For example, when only the jetting timing adjustment for compensating for the shift of ink landing positions caused by the inclination of each nozzle array 9 is executed in the first adjustment processing of the step S106, the controller 50 may adjust the jetting timing based on the value of the parameter A after being changed by the first information change processing of the step S206. In that case, ink jetted at the adjusted jetting timing has no landing failure, thus eliminating the first restriction processing of the step S108.

In the above embodiment, the controller 50 determines whether ink jetted at the jetting timing adjusted by the first adjustment processing of the step S106 lands on the margin Y (S109). When the controller 50 has determined that ink lands on the margin Y, the controller 50 executes the second restriction processing (S110). The present teaching, however, is not limited thereto. The processing of the steps S109 and S110 may not be performed. For example, when only the jetting timing adjustment for compensating for the shift of ink landing positions caused by the inclination of each nozzle array 9 is executed in the first adjustment processing of the step S106, the controller 50 may adjust the jetting timing based on the value of the parameter A after being changed by the second information change processing of the step S208. In that case, ink jetted at the adjusted jetting timing does not land on the margin Y, thus eliminating the second restriction processing of the step S110.

When only the jetting timing adjustment for compensating for the shift of ink landing positions caused by the inclination of each nozzle array 9 is executed in the first adjustment processing of the step S106, the second adjustment processing of the step S111 is unnecessary. When M is 1 (S102: YES) and the image E to be printed by the next scan printing is not connected continuously to the image E to be printed by the last scan printing (S103: NO), it is only necessary to perform the ink-jet processing of the step S112.

In the above embodiment, the values $A_1$ to $A_8$ of the parameter A at the eight positions $P_1$ to $P_8$ in the scanning direction are stored in the EEPROM 54. The controller 50 adjusts the jetting timing at each position between the positions $P_1$ to $P_8$ based on interpolation information generated from the values $A_1$ to $A_8$ of the parameter A. The present teaching, however, is not limited thereto.

Figure 14:
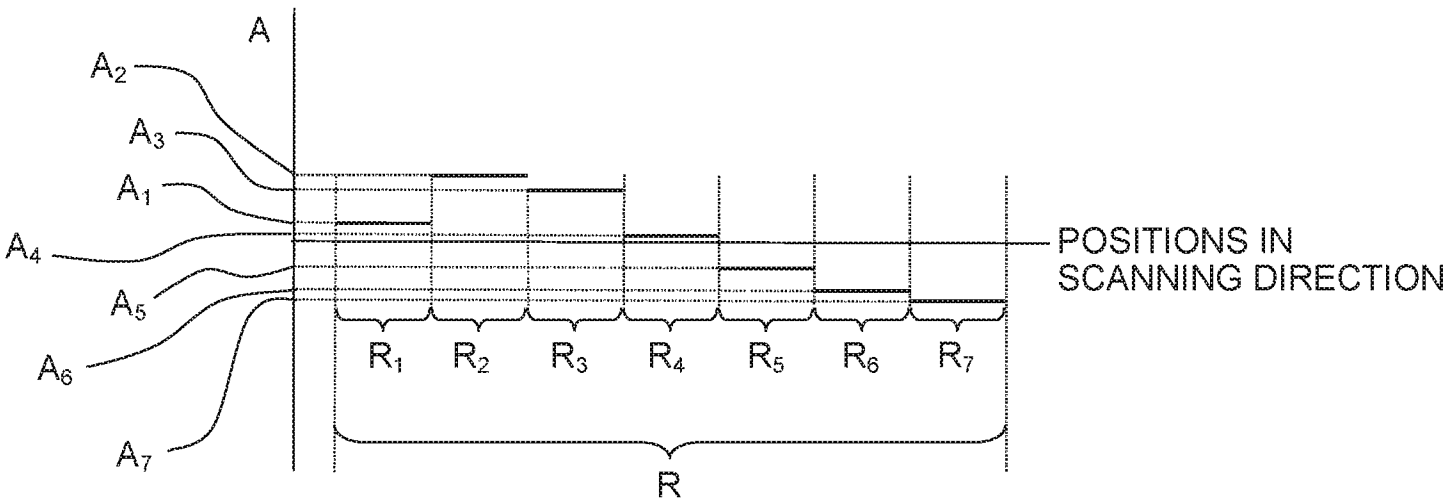
FIG. 14 is a diagram that corresponds to FIG. 7 according to a first modified embodiment.

For example, in a first modified embodiment, as depicted in FIG. 14, each of the values $A_1$ to $A_7$ of the parameter A for the corresponding one of seven divided areas $R_1$ to $R_7$ is stored in the EEPROM 54, the seven divided areas $R_1$ to $R_7$ being obtained by dividing a movement area R of the ink-jet head 12 for scan printing into seven areas in the scanning direction. In the first adjustment processing of the step S106, the controller 50 adjusts the jetting timing at each of the divided areas $R_1$ to $R_7$ based on the value of the parameter A corresponding to the divided area. In that case also, the EEPROM 54 may be decreased in capacity, compared to a case in which the values of the parameter A at all the positions in the scanning direction required for jetting timing adjustment are stored in the EEPROM 54 individually. The number of divided areas is an example, and the divided areas may be obtained by dividing the movement area R into six or less areas or eight or more areas.

Further, the values of the parameter A at all the positions in the scanning direction required for jetting timing adjustment may be stored in the EEPROM 54 individually. In the first adjustment processing of the step S106, the controller 50 may adjust jetting timing at each position in the scanning direction based on the value of the parameter A at each position.

In the above embodiment, the controller 50 delays the jetting timing in the second or subsequent scan printing relative to the jetting timing in the last scan printing such that the jetting timing is delayed relative to the reference timing more greatly in later scan printing (as the value of the M is greater). The present teaching, however, is not limited thereto. The controller 50 may delay the jetting timing in the second or subsequent scan printing relative to the jetting timing in the last scan printing such that the jetting timing is advanced relative to the reference timing more greatly in earlier scan printing (as the value of the M is smaller).

In the above embodiment, the controller 50 advances the jetting timing in the second or subsequent scan printing relative to the jetting timing in the last scan printing such that the jetting timing is advanced relative to the reference timing more greatly in later scan printing (as the value of the M is greater). The present teaching, however, is not limited thereto. The controller 50 may advance the jetting timing in the second or subsequent scan printing relative to the jetting timing in the last scan printing such that the jetting timing is delayed relative to the reference timing more greatly in earlier scan printing (as the value of the M is smaller).

In the above embodiment, the length L of each nozzle array 9 is not less than 1.2 inches. The length L of each nozzle array 9, however, may be less than 1.2 inches.

In the above embodiment, the controller 50 determines whether ink jetted at the jetting timing adjusted based on the value of the parameter A obtained by the inclination information obtaining processing of the step S204 has landing failure (S205). When the controller 50 has determined that the ink landing failure occurs, the controller 50 executes the first information change processing (S206). The present teaching, however, is not limited thereto. The controller 50 may not execute processing of the steps S205 and S206. Even when the value of the parameter A obtained by the inclination information obtaining processing of the step S204 is a value that causes ink jetted at the jetting timing adjusted based on the value of the parameter A to have landing failure, ink landing failure may be prevented, because the controller 50 may execute the first restriction processing of the step S108 to restrict the jetting timing adjustment in printing.

In the above embodiment, the predefined value $B_n$, of which magnitude is compared with that of the value $A_n$ of the parameter A in the step S107, is smaller toward outside positions in the scanning direction. The present teaching, however, is not limited thereto. For example, the predefined value $B_n$ may not depend on the position in the scanning direction, and may be a constant value.

In the above embodiment, the controller 50 determines whether the value $A_n$ of the parameter A obtained by the inclination information obtaining processing of the step S204 exceeds the predefined value $B_n$ (S207). When the value $A_n$ of the parameter A exceeds the predefined value $B_n$, the controller 50 executes the second information change processing for changing the value $A_n$ of the parameter A to a value making the absolute value $|A_n|$ the predefined value $B_n$ or smaller (S208). The present teaching, however, is not limited thereto. The controller 50 may not perform processing of the steps S207 and S208. Even when the absolute value $|A_n|$ of the parameter A obtained by the inclination information obtaining processing of the step S204 exceeds the predefined value $B_n$ so that ink jetted at the jetting timing adjusted based on the value of the parameter A will land on the margin Y, the ink may be prevented from landing on the margin Y, because the controller 50 may execute the second restriction processing of the step S110 to restrict the jetting timing adjustment in printing.

In the above embodiment, the linear patterns $H1_F$, $H1_R$, $H2_F$, and $H2_R$ are printed such that two pairs of linear patterns $H1_F$ and $H2_F$ and two pairs of linear patterns $H1_R$ and $H2_R$ are alternately arranged in the scanning direction. The present teaching, however, is not limited thereto. For example, the linear patterns $H1_F$, $H1_R$, $H2_F$, and $H2_R$ may be printed such that a pairs of linear patterns $H1_F$ and $H2_F$ and a pair of linear patterns $H1_R$ and $H2_R$ are alternately arranged in the scanning direction. Or, the linear patterns $H1_F$, $H1_R$, $H2_F$, and $H2_R$ may be printed such that three or more pairs of linear patterns $H1_F$ and $H2_F$ and three or more pairs of linear patterns $H1_R$ and $H2_R$ are alternately arranged in the scanning direction.

The present teaching is not limited to the printing in which the pair(s) of linear patterns $H1_F$ and $H2_F$ and the pairs(s) of linear patterns $H1_R$ and $H2_R$ are arranged in the scanning direction. For example, the pair(s) of linear patterns $H1_F$ and $H2_F$ arranged in the scanning direction may be printed in an area of the recording sheet S, and the pairs(s) of linear patterns $H1_R$ and $H2_R$ arranged in the scanning direction may be printed in an area of the recording sheet S shifted from the area formed with the linear patterns $H1_F$ and $H2_F$ in the conveyance direction.

Further, only the pair(s) of linear patterns $H1_F$ and $H2_F$ arranged in the scanning direction may be printed on the recording sheet S, and the values $A_1$ to $A_8$ of the parameter A may be obtained based only on position(s) of the intersection(s) $X_F$ of the linear patterns $H1_F$ and $H2_F$ in the conveyance direction. Similarly, only the pair(s) of linear patterns $H1_R$ and $H2_R$ arranged in the scanning direction may be printed on the recording sheet S, and the values $A_1$ to $A_8$ of the parameter A may be obtained based only on position(s) of the intersection(s) $X_R$ of the linear patterns $H1_R$ and $H2_R$ in the conveyance direction.

In the above embodiment, the controller 50 executes the inclination information obtaining processing for obtaining the values A1 to A8 of the parameter A based on the reading result of the linear patterns $H1_F$, $H1_R$, $H2_F$, and $H2_R$ by the reading unit 5. The present teaching, however, is not limited thereto. For example, the linear patterns $H1_F$, $H1_R$, $H2_F$, and $H2_R$ printed by the printer 1 may be read by a scanner different from that of the printer 1, and the values $A_1$ to $A_8$ of the parameter A may be obtained by a PC connected to the scanner based on the reading result. In that case, information of the values $A_1$ to $A_8$ of the parameter A obtained by the PC may be written in the EEPROM 54 of the printer 1.

In the above case, the controller 50 may execute the processing of steps S205 to S208 similarly to the above embodiment, after information of the values $A_1$ to $A_8$ of the parameter A is written in the EEPROM 54. Or, information of the values $A_1$ to $A_8$ of the parameter A may be written in the EEPROM 54 after the PC executes processing similar to the steps S205 to S208. In that case, the printer 1 is not limited to the multifunction peripheral including the printing unit 2, the reading unit 5, and the like, and the printer 1 may be one that can perform printing only.

In the above embodiment, the first linear patterns $H1_F$ and $H1_R$ and the second linear patterns $H2_F$ and $H2_R$ intersecting with each other are printed, and values of the parameter A are obtained based on positions of the intersection points $X_F$ and $X_R$ in the conveyance direction. The patterns to be printed for obtaining the parameter A are not limited to thereto.

Figure 15A:
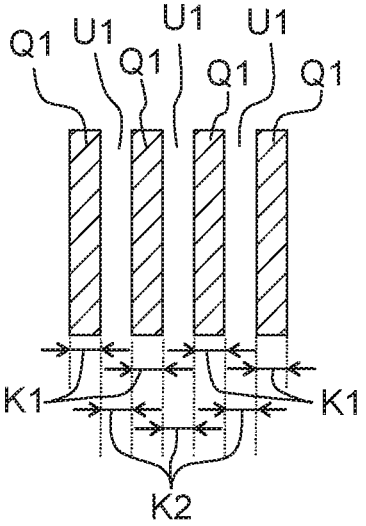
FIG. 15A depicts first patterns according to a second modified embodiment.
Figure 15B:
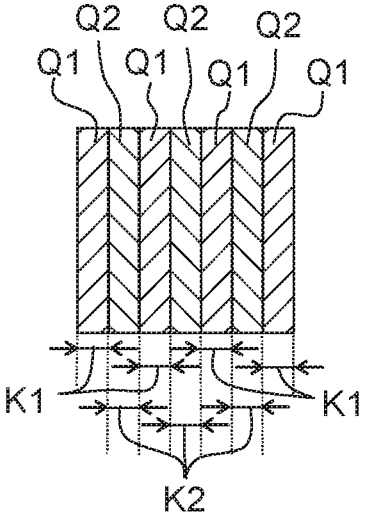
FIG. 15B depicts a positional relation between the first patterns and second patterns in a state where no nozzle array is inclined according to the second modified embodiment.

For example, in a second modified embodiment, in the first pattern printing processing of the step S201, the controller 50 controls the ink-jet head 12 to jet ink from the first nozzles while moving the carriage 11 rightward or leftward. Accordingly, strip-like first patterns Q1 (four patterns in FIG. 15A) each having a length K1 in the scanning direction are printed on the recording sheet S in the vicinities of the positions $P_1$ to $P_8$ such that the first patterns Q1 are arranged in the scanning direction at intervals U1 each having a length K2 in the scanning direction, as depicted in FIG. 15A. Further, in the second pattern printing processing of the step S202, the controller 50 controls the ink-jet head 12 to jet ink from the second nozzles while moving the carriage 11 in the same direction as that of the first pattern Q1 printing. Accordingly, strip-like second patterns Q2 (three patterns in FIG. 15B) each having a length K2 in the scanning direction, the number of which is smaller than that of the first patterns Q1 by one, are printed on the recording sheet S in the vicinities of the positions $P_1$ to $P_8$ such that the second patterns Q2 are arranged in the scanning direction at intervals each having a length K1 in the scanning direction, as depicted in FIG. 15B. In that case, when each nozzle array 9 is parallel to the conveyance direction, the second patterns Q2 are printed in the step S202 such that the second patterns Q2 overlap completely with the intervals U1, as depicted in FIG. 15B.

Figure 15C:
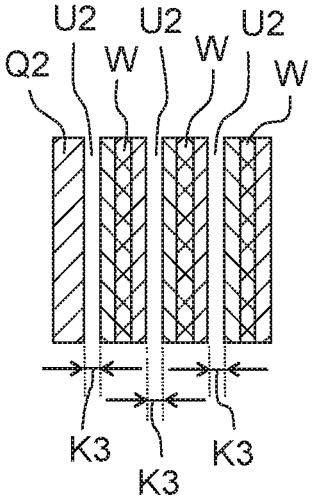
FIG. 15C depicts a positional relation between the first patterns and the second patterns in a state where each nozzle array is inclined rightward according to the second modified embodiment.
Figure 15D:
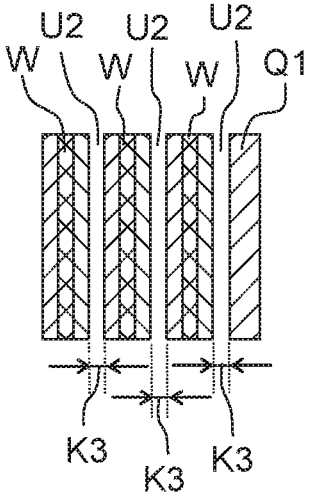
FIG. 15D depicts a positional relation between the first patterns and the second patterns in a state where each nozzle array is inclined leftward according to the second modified embodiment.

When each nozzle array 9 is inclined rightward, the second patterns Q2 are shifted rightward relative to the first patterns Q1, as depicted in FIG. 15C. This causes the first patterns Q1 except the leftmost first pattern Q1 to partially overlap with the second patterns Q2, thus forming a single strip-like pattern W of which length in the scanning direction is longer than the length K1. When each nozzle array 9 is inclined leftward, the second patterns Q2 are shifted leftward relative to the first patterns Q1, as depicted in FIG. 15D. This causes the first patterns Q1 except the rightmost first pattern Q1 to partially overlap with the second patterns Q2, thus forming a single strip-like pattern W of which length in the scanning direction is longer than the length K1. In the above cases, intervals U2 are formed between the first pattern Q1 and the pattern W and between two adjacent patterns W. A length K3 of the interval U2 in the scanning direction is longer, as the inclination of each nozzle array 9 with respect to the conveyance direction is greater. Further, in the inclination information obtaining processing of the step S204 according to the second modified embodiment, values of the parameter A are obtained based on the length K3 of the interval U and which one of the two first patterns Q1 on the rightmost and leftmost positions is formed as the pattern W (which one of the two first patterns Q1 on the rightmost and leftmost positions has a longer length in the scanning direction).

In the above embodiment, the contact parts 11*a* and 11*b* of the carriage 11 are in contact with the guide surfaces 22*a* and 22*b* of the guide rail 22, and the carriage 11 is guided by the guide surfaces 22*a* and 22*b* sliding with the contact parts 11*a* and 11*b*. The present teaching, however, is not limited thereto. For example, a guide bar extending in the scanning direction may be inserted into the carriage, and the carriage may move in the scanning direction while being guided by the guide bar.

The above description is an example in which the present teaching is applied to the printer that jets ink from nozzles to perform printing. The present teaching, however, is not limited thereto. The present teaching may be applied to a printer that jets a liquid other than ink, such as materials of a wiring pattern to be printed on a wiring substrate, to perform printing.

What is claimed is:

1. A printer comprising:

a conveyor configured to convey a recording medium in a conveyance direction;

a liquid jetting head including a nozzle array in which a plurality of nozzles are aligned in the conveyance direction;

a carriage carrying the liquid jetting head;

a guide guiding the carriage;

a carriage moving unit configured to move the carriage in a moving direction in a state where the carriage is guided by the guide, the moving direction being a direction intersecting with the conveyance direction;

a memory configured to store pieces of inclination information at positions in the moving direction, each piece of inclination information relating to inclination of the nozzle array with respect to the conveyance direction within a plane parallel to the conveyance direction and the moving direction, the inclination being caused by a deformation of the guide; and a controller configured to control the conveyor, the liquid jetting head, and the carriage moving unit, to perform:

printing by performing a scan printing operation and a conveyance operation multiple times repeatedly, wherein, in the scan printing operation, the liquid jetting head is controlled to jet the liquid from the nozzles while the carriage is moved in the moving direction, and in the conveyance operation, the conveyor is controlled to convey the recording medium in the conveyance direction; and adjusting a jetting timing of the liquid at each of the positions based on the inclination information corresponding to each of the positions, wherein, in second or subsequent scan printing operation of the multiple times of scan printing operation, the controller is configured to perform:

delaying the jetting timing in the second or subsequent scan printing operation relative to the jetting timing in scan printing operation immediately before the second or subsequent scan printing operation more greatly as the inclination increases, in a case that the inclination information indicates inclination in which a most downstream nozzle, of the nozzle array, in the conveyance direction is positioned upstream in the moving direction with respect to a most upstream nozzle, of the nozzle array, in the conveyance direction; and advancing the jetting timing in the second or subsequent scan printing operation relative to the jetting timing in the scan printing operation immediately before the second or subsequent scan printing operation more greatly as the inclination increases, in a case that the inclination information indicates inclination in which the most downstream nozzle in the conveyance direction is positioned downstream in the moving direction with respect to the most upstream nozzle in the conveyance direction.

2. The printer according to claim 1, wherein the memory is configured to store, as the inclination information at each of the positions, each piece of information relating to the inclination of the nozzle array at a corresponding one of divided areas which are obtained by dividing, in the moving direction, a movement area of the liquid jetting head for the scan printing operation such that the divided areas are adjacent to each other in the moving direction; and the controller is configured to adjust the jetting timing at each of the divided areas based on the inclination information at each of the divided areas.

3. The printer according to claim 1, wherein the controller is configured to perform:

generating interpolation information to be used for interpolation of the inclination information at a position between two positions, of the positions in the moving direction, adjacent to each other, based on the pieces of inclination information of the two positions adjacent to each other; and adjusting the jetting timing at the position between the two positions based on the interpolation information.

4. The printer according to claim 1, wherein the controller is configured to perform:

determining whether the liquid jetted from the nozzles at the jetting timing after the adjustment is to have landing failure;

the landing failure being a situation in which the liquid jetted at a latter jetting timing, of two jetting timings which are successive in the scan printing operation, partially lands on the same position as the liquid jetted at a former jetting timing or partially lands on a position upstream of the liquid jetted at the former timing in the moving direction, and restricting the adjustment of at least one of the two jetting timings to make the liquid jetted at the latter jetting timing land on a position downstream of the liquid jetted at the former jetting timing in the moving direction, in a case that the controller has determined that the landing failure is to occur.

5. The printer according to claim 1, wherein the controller is configured to perform:

determining whether the liquid jetted from the nozzles at each jetting timing after the adjustment in the scan printing operation is to land on a position outside a predefined limit position in the moving direction ; and restricting the adjustment of the jetting timing for which the controller has determined that the liquid is to land on the position outside the limit position, to make the liquid land on a position inside the limit position.

6. The printer according to claim 1, wherein the controller is configured to perform:

determining whether an image to be printed in scan printing operation is connected continuously in the conveyance direction to an image to be printed in scan printing operation immediately before the scan printing operation; and adjusting jetting timings of the liquid jetted from the nozzles at the positions in the scan printing operation, based on the pieces of inclination information at the respective positions, in a case that the controller has determined that the image to be printed in the scan printing operation is connected continuously to the image to be printed in the scan printing operation immediately before the scan printing operation, and the controller is configured not to perform adjusting the jetting timings of the liquid jetted from the nozzles at the positions in the scan printing operation, based on the pieces of inclination information at the respective positions, in a case that the controller has determined that the image to be printed in the scan printing operation is not connected continuously to the image to be printed in the scan printing operation immediately before the scan printing operation.

7. The printer according to claim 1, wherein the nozzle array has a length of 1.2 inches or longer in the conveyance direction.

8. A method of obtaining inclination information to obtain the inclination information of a guide of a printer, the printer including:

a conveyor configured to convey a recording medium in a conveyance direction;

a liquid jetting head having a nozzle array in which nozzles are arrayed in the conveyance direction;

a carriage carrying the liquid jetting head;

a guide guiding the carriage; and a carriage moving unit configured to move the carriage in a moving direction in a state where the carriage is guided by the guide, the moving direction being a direction intersecting with the conveyance direction, the method comprising:

printing first patterns on the recording medium such that the first patterns are arranged in the moving direction by jetting liquid from first nozzles, of the nozzles, disposed upstream side in the moving direction while moving the carriage in the moving direction;

printing second patterns on the recording medium such that the second patterns are arranged in the moving direction by jetting the liquid from second nozzles, of the nozzles, disposed downstream of the first nozzles, while moving the carriage in the moving direction; and obtaining the inclination information based on a position relation between the first patterns and the second patterns.

9. The method of obtaining the inclination information according to claim 8, wherein first linear patterns are printed, as the first patterns, on the recording medium such that the first linear patterns extend in the conveyance direction and are arranged in the moving direction;

second linear patterns are printed, as the second patterns, on the recording medium such that the second linear patterns extend in the conveyance direction and intersect with the first linear patterns; and the inclination information is obtained based on positions of intersection points of the first linear patterns and the second linear patterns in the conveyance direction.

10. The method of obtaining the inclination information according to claim 8, further comprising:

determining whether liquid landing failure is to occur in a case that the jetting timing in a scan printing operation is determined based on the inclination information obtained, the liquid landing failure being a situation in which the liquid jetted at a latter jetting timing, of two jetting timings which are successive in the scan printing operation, partially lands on the same position as the liquid jetted at a former jetting timing or partially lands on a position upstream of the liquid jetted at the former timing in the moving direction, and changing the inclination information corresponding to at least one of the two jetting timings to make the liquid jetted at the latter jetting timing land on a position downstream of the liquid jetted at the former jetting timing in the moving direction, in a case that it has been determined that the liquid landing failure is to occur.

11. The method of obtaining the inclination information according to claim 8, further comprising, in a case that the inclination information obtained indicates that an inclination angle of the nozzle array with respect to the conveyance direction is greater than a predefined upper limit angle, changing the inclination information obtained into inclination information indicating that the inclination angle is not more than the upper limit angle.

12. The method of obtaining the inclination information according to claim 11, wherein the upper limit angle is determined at each of the positions in the moving direction; and the upper limit angle is smaller toward outside positions in the moving direction.

* * * * *